US006003867A

United States Patent [19]

Rodesch et al.

[11] Patent Number: 6,003,867

[45] Date of Patent: Dec. 21, 1999

[54] REEL TYPE SLOT MACHINE UTILIZING TIME-BASED RANDOM GAME RESULT SELECTION MEANS

[75] Inventors: Dale F. Rodesch, San Diego; Gregory L. Rodesch, Oceanside, both of Calif.

[73] Assignee: Unislot, Inc., Calif.

[21] Appl. No.: 08/955,846

[22] Filed: Oct. 21, 1997

Related U.S. Application Data

[63] Continuation of application No. 08/876,046, Jun. 13, 1997.

[51] Int. Cl.[6] ..... A63F 5/04; A63B 71/06; G07F 17/34

[52] U.S. Cl. ..... 273/143 R; 463/20

[58] Field of Search ..... 463/1, 16, 20, 463/26, 29–30; 273/143 R, 139, 138.1, 138.2

[56] References Cited

U.S. PATENT DOCUMENTS

| | | | |
|---|---|---|---|
| 3,439,281 | 4/1969 | McGuire et al. . | |
| 3,580,581 | 5/1971 | Raven | 273/138 A |
| 3,586,953 | 6/1971 | Markkanen | 318/635 |
| 3,606,337 | 9/1971 | Larsen et al. . | |
| 3,684,290 | 8/1972 | Wayne | 273/143 C |
| 3,770,269 | 11/1973 | Elder | 271/1 E |
| 3,834,712 | 9/1974 | Cox | 273/143 R |
| 3,838,258 | 9/1974 | Logan | 235/151.11 |
| 3,838,259 | 9/1974 | Kortenhaus | 235/152 |
| 3,913,922 | 10/1975 | Richards et al. | 273/143 R |
| 3,918,716 | 11/1975 | Nonaka et al. . | |
| 4,095,795 | 6/1978 | Saxton et al. | 273/143 R |

(List continued on next page.)

FOREIGN PATENT DOCUMENTS

| | | |
|---|---|---|
| 268377 | of 0000 | Australia . |
| 962770 | of 0000 | Canada . |
| 2 054 289 | 6/1971 | Germany . |
| 2 209 165 | 8/1973 | Germany . |
| 2 232 107 | 11/1973 | Germany . |
| 2 337 548 | 2/1974 | Germany . |
| 1072381 | of 0000 | United Kingdom . |
| 1107552 | of 0000 | United Kingdom . |
| 1178302 | of 0000 | United Kingdom . |
| 1252259 | of 0000 | United Kingdom . |
| 1348309 | of 0000 | United Kingdom . |
| 1368622 | of 0000 | United Kingdom . |
| 1424713 | of 0000 | United Kingdom . |
| 1430007 | of 0000 | United Kingdom . |
| 1471866 | of 0000 | United Kingdom . |
| 1545301 | of 0000 | United Kingdom . |
| 1579731 | of 0000 | United Kingdom . |
| 1596363 | of 0000 | United Kingdom . |
| 2065352 | of 0000 | United Kingdom . |

OTHER PUBLICATIONS

L.C. Meyer et al., "Random Generator Study", Jan. 1, 1974 pp. 3–1 through 3–3.

Waller M. Scott, "Electronic Casino", Mar. 1974 pp. 51–58.

*Primary Examiner*—Valencia Martin-Wallace
*Assistant Examiner*—Mark A. Sager
*Attorney, Agent, or Firm*—Lockwood, Alex, FitzGibbon & Cummings

[57] ABSTRACT

A reel-type slot machine includes a microprocessor driven game control circuit for randomly selecting a game result. Three reel assemblies each include a symbol-bearing display reel driven by a stepper motor for displaying game symbols corresponding to the game result. A series of signals representing potential game results is repetitively generated within the game control circuits. Upon user actuation of a spin switch one of the game results is randomly selected for application to a look-up table wherein the corresponding three game symbols to be displayed are identified. The number of repetitions of a potential game result in the series establishes a time window of availability for the result, and hence the probability of that game result being selected. After the three game symbols have been identified, the display reels are driven by their respective stepper motors to display the game symbols. Optional ramp-up and ramp-down circuits provide improved stopping accuracy.

44 Claims, 24 Drawing Sheets

U.S. PATENT DOCUMENTS

| | | | |
|---|---|---|---|
| 4,099,722 | 7/1978 | Rodesch et al. | 273/143 R |
| 4,138,114 | 2/1979 | Anderson | 273/143 R |
| 4,238,127 | 12/1980 | Lucero et al. | 273/143 R |
| 4,299,388 | 11/1981 | Resch et al. | 273/143 R |
| 4,421,310 | 12/1983 | Williams | 273/143 R |
| 4,448,419 | 5/1984 | Telnaes | 273/143 R |
| 4,573,681 | 3/1986 | Okada | 273/143 R |
| 4,618,150 | 10/1986 | Kimura | 273/143 R |
| 4,637,611 | 1/1987 | Hamada | 273/143 R |
| 4,660,833 | 4/1987 | Dickinson et al. | 273/143 R |
| 4,687,981 | 8/1987 | Okada | 318/696 |
| 4,693,477 | 9/1987 | Dickinson et al. | 273/143 R |
| 4,711,451 | 12/1987 | Pajak et al. | 273/143 R |
| 4,772,023 | 9/1988 | Okada | 273/143 R |
| 4,858,932 | 8/1989 | Keane | 173/143 R |
| 4,911,449 | 3/1990 | Dickinson et al. | 273/143 R |
| 4,912,389 | 3/1990 | Eguchi | 218/694 |
| 5,050,881 | 9/1991 | Nagao | 273/143 R |
| 5,058,893 | 10/1991 | Dickinson et al. | 273/143 R |
| 5,074,559 | 12/1991 | Okada | 273/143 R |
| 5,083,785 | 1/1992 | Okada | 273/143 R |
| 5,085,436 | 2/1992 | Bennett | 273/143 R |
| 5,102,134 | 4/1992 | Smyth | 173/138 A |
| 5,102,137 | 4/1992 | Ekiert | 273/143 R |
| 5,108,099 | 4/1992 | Smyth | 273/138 A |
| 5,154,421 | 10/1992 | Hamano | 273/143 R |
| 5,169,147 | 12/1992 | Hamano | 273/138 A |
| 5,205,555 | 4/1993 | Hamano | 273/143 R |
| 5,209,479 | 5/1993 | Nagao et al. | 273/143 R |
| 5,263,716 | 11/1993 | Smyth | 273/138 A |
| 5,380,008 | 1/1995 | Mathis et al. | 273/143 R |
| 5,423,541 | 6/1995 | Nicastro et al. | 273/143 R |
| 5,456,465 | 10/1995 | Durham | 273/138 A |
| 5,456,466 | 10/1995 | Miles | 273/143 R |
| 5,511,784 | 4/1996 | Furry et al. | 372/143 R |
| 5,524,888 | 6/1996 | Heidel | 463/22 |
| 5,564,701 | 10/1996 | Dettor | 463/16 |
| 5,569,084 | 10/1996 | Nicastro et al. | 463/20 |

FIG. 1
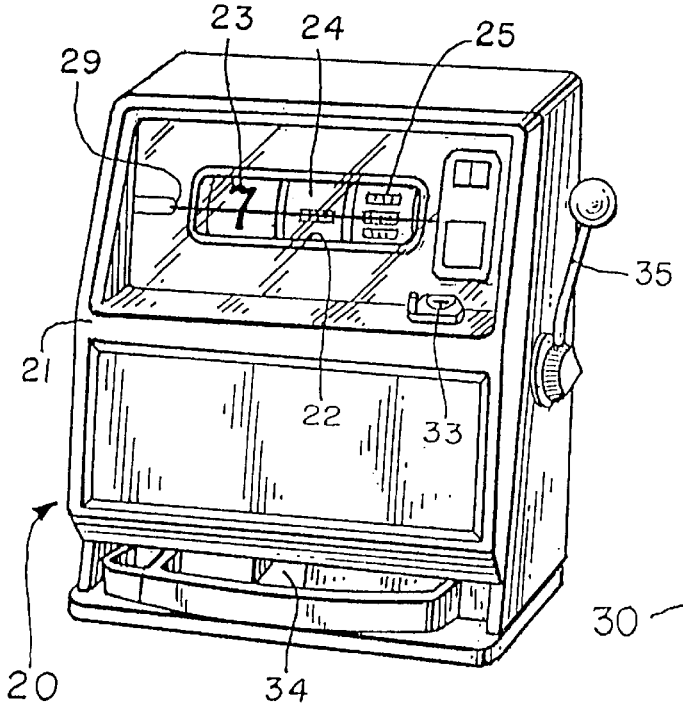
FIG. 3
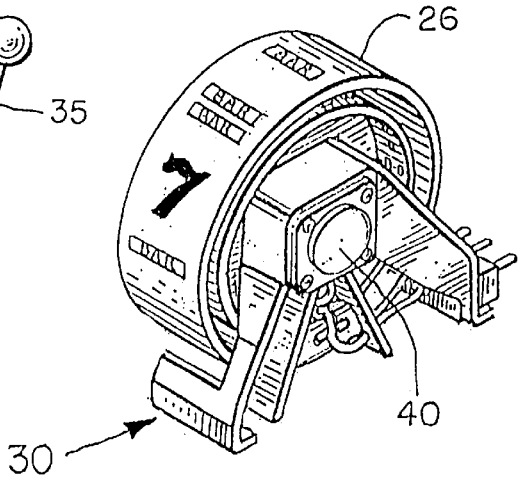
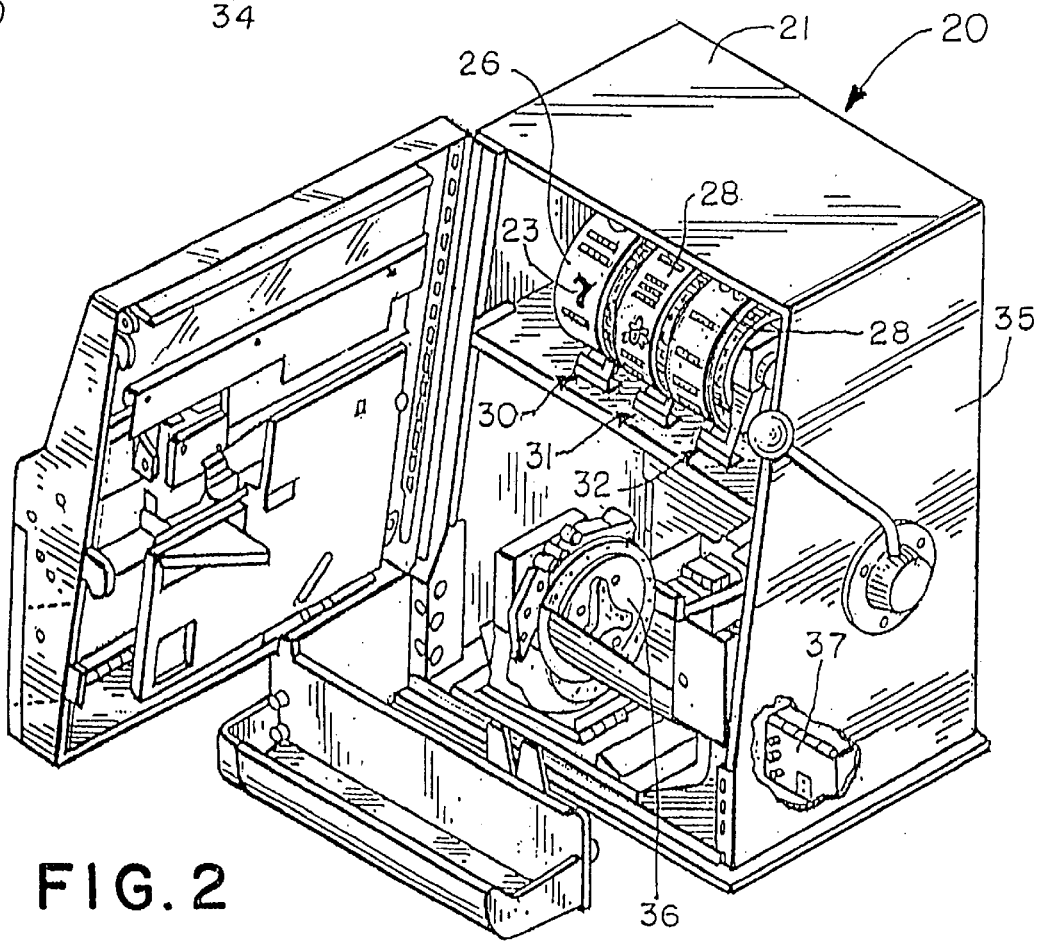
FIG. 2

| | Reel 1 | Reel 2 | Reel 3 | Subset | | Weight | Probability | Payout |
|---|---|---|---|---|---|---|---|---|
| | | | | From | To | | | |
| 1 | – | – | – | 0 | 2,416,821 | 2,416,822 | 0.009003364 | 0 |
| 2 | – | – | Ba | 2,416,822 | 4,833,643 | 2,416,822 | 0.009003364 | 0 |
| 3 | – | – | DB | 4,833,644 | 7,250,465 | 2,416,822 | 0.009003364 | 0 |
| 4 | – | – | 7 | 7,250,466 | 9,667,287 | 2,416,822 | 0.009003364 | 0 |
| 5 | – | – | TB | 9,667,288 | 12,084,109 | 2,416,822 | 0.009003364 | 0 |
| 6 | – | Ba | – | 12,084,110 | 14,500,931 | 2,416,822 | 0.009003364 | 0 |
| 7 | – | Ba | Ba | 14,500,932 | 16,917,753 | 2,416,822 | 0.009003364 | 0 |
| 8 | – | Ba | DB | 16,917,754 | 19,334,575 | 2,416,822 | 0.009003364 | 0 |
| 9 | – | Ba | 7 | 19,334,576 | 21,751,397 | 2,416,822 | 0.009003364 | 0 |
| 10 | – | Ba | TB | 21,751,398 | 24,168,219 | 2,416,822 | 0.009003364 | 0 |
| 11 | – | DB | – | 24,168,220 | 26,585,041 | 2,416,822 | 0.009003364 | 0 |
| 12 | – | DB | Ba | 26,585,042 | 29,001,863 | 2,416,822 | 0.009003364 | 0 |
| 13 | – | DB | DB | 29,001,864 | 31,418,685 | 2,416,822 | 0.009003364 | 0 |
| 14 | – | DB | 7 | 31,418,686 | 33,835,507 | 2,416,822 | 0.009003364 | 0 |
| 15 | – | DB | TB | 33,835,508 | 36,252,329 | 2,416,822 | 0.009003364 | 0 |
| 16 | – | 7 | – | 36,252,330 | 38,669,151 | 2,416,822 | 0.009003364 | 0 |
| 17 | – | 7 | Ba | 38,669,152 | 41,085,973 | 2,416,822 | 0.009003364 | 0 |
| 18 | – | 7 | DB | 41,085,974 | 43,502,795 | 2,416,822 | 0.009003364 | 0 |
| 19 | – | 7 | 7 | 43,502,796 | 45,919,617 | 2,416,822 | 0.009003364 | 0 |
| 20 | – | 7 | TB | 45,919,618 | 48,336,439 | 2,416,822 | 0.009003364 | 0 |
| 21 | – | TB | – | 48,336,440 | 50,753,261 | 2,416,822 | 0.009003364 | 0 |
| 22 | – | TB | Ba | 50,753,262 | 53,170,083 | 2,416,822 | 0.009003364 | 0 |
| 23 | – | TB | DB | 53,170,084 | 55,586,905 | 2,416,822 | 0.009003364 | 0 |
| 24 | – | TB | 7 | 55,586,906 | 58,003,727 | 2,416,822 | 0.009003364 | 0 |
| 25 | – | TB | TB | 58,003,728 | 60,420,549 | 2,416,822 | 0.009003364 | 0 |
| 26 | Ba | – | – | 60,420,550 | 62,837,371 | 2,416,822 | 0.009003364 | 0 |
| 27 | Ba | – | Ba | 62,837,372 | 65,254,193 | 2,416,822 | 0.009003364 | 0 |
| 28 | Ba | – | DB | 65,254,194 | 67,671,015 | 2,416,822 | 0.009003364 | 0 |
| 29 | Ba | – | 7 | 67,671,016 | 70,087,837 | 2,416,822 | 0.009003364 | 0 |
| 30 | Ba | – | TB | 70,087,838 | 72,504,659 | 2,416,822 | 0.009003364 | 0 |
| 31 | Ba | Ba | – | 72,504,660 | 74,921,481 | 2,416,822 | 0.009003364 | 0 |
| 32 | Ba | Ba | 7 | 74,921,482 | 77,338,303 | 2,416,822 | 0.009003364 | 0 |
| 33 | Ba | DB | – | 77,338,304 | 79,755,125 | 2,416,822 | 0.009003364 | 0 |
| 34 | Ba | DB | 7 | 79,755,126 | 82,171,947 | 2,416,822 | 0.009003364 | 0 |
| 35 | Ba | 7 | – | 82,171,948 | 84,588,769 | 2,416,822 | 0.009003364 | 0 |
| 36 | Ba | 7 | Ba | 84,588,770 | 87,005,591 | 2,416,822 | 0.009003364 | 0 |
| 37 | Ba | 7 | DB | 87,005,592 | 89,422,413 | 2,416,822 | 0.009003364 | 0 |
| 38 | Ba | 7 | 7 | 89,422,414 | 91,839,235 | 2,416,822 | 0.009003364 | 0 |
| 39 | Ba | 7 | TB | 91,839,236 | 94,256,057 | 2,416,822 | 0.009003364 | 0 |
| 40 | Ba | TB | – | 94,256,058 | 96,672,879 | 2,416,822 | 0.009003364 | 0 |
| 41 | Ba | TB | 7 | 96,672,880 | 99,089,701 | 2,416,822 | 0.009003364 | 0 |
| 42 | DB | – | – | 99,089,702 | 101,506,523 | 2,416,822 | 0.009003364 | 0 |
| 43 | DB | – | Ba | 101,506,524 | 103,923,345 | 2,416,822 | 0.009003364 | 0 |
| 44 | DB | – | DB | 103,923,346 | 106,340,167 | 2,416,822 | 0.009003364 | 0 |

FIG. 10A

| | Reel 1 | Reel 2 | Reel 3 | Subset | | Weight | Probability | Payout |
|---|---|---|---|---|---|---|---|---|
| | | | | From | To | | | |
| 45 | DB | – | 7 | 106,340,168 | 108,756,989 | 2,416,822 | 0.009003364 | 0 |
| 46 | DB | – | TB | 108,756,990 | 111,173,811 | 2,416,822 | 0.009003364 | 0 |
| 47 | DB | Ba | – | 111,173,812 | 113,590,633 | 2,416,822 | 0.009003364 | 0 |
| 48 | DB | Ba | 7 | 113,590,634 | 116,007,455 | 2,416,822 | 0.009003364 | 0 |
| 49 | DB | DB | – | 116,007,456 | 118,424,277 | 2,416,822 | 0.009003364 | 0 |
| 50 | DB | DB | 7 | 118,424,278 | 120,841,099 | 2,416,822 | 0.009003364 | 0 |
| 51 | DB | 7 | – | 120,841,100 | 123,257,921 | 2,416,822 | 0.009003364 | 0 |
| 52 | DB | 7 | Ba | 123,257,922 | 125,674,743 | 2,416,822 | 0.009003364 | 0 |
| 53 | DB | 7 | DB | 125,674,744 | 128,091,565 | 2,416,822 | 0.009003364 | 0 |
| 54 | DB | 7 | 7 | 128,091,566 | 130,508,387 | 2,416,822 | 0.009003364 | 0 |
| 55 | DB | 7 | TB | 130,508,388 | 132,925,209 | 2,416,822 | 0.009003364 | 0 |
| 56 | DB | TB | – | 132,925,210 | 135,342,031 | 2,416,822 | 0.009003364 | 0 |
| 57 | DB | TB | 7 | 135,342,032 | 137,758,853 | 2,416,822 | 0.009003364 | 0 |
| 58 | 7 | – | – | 137,758,854 | 140,175,675 | 2,416,822 | 0.009003364 | 0 |
| 59 | 7 | – | Ba | 140,175,676 | 142,592,497 | 2,416,822 | 0.009003364 | 0 |
| 60 | 7 | – | DB | 142,592,498 | 145,009,319 | 2,416,822 | 0.009003364 | 0 |
| 61 | 7 | – | 7 | 145,009,320 | 147,426,141 | 2,416,822 | 0.009003364 | 0 |
| 62 | 7 | – | TB | 147,426,142 | 149,842,963 | 2,416,822 | 0.009003364 | 0 |
| 63 | 7 | Ba | – | 149,842,964 | 152,259,785 | 2,416,822 | 0.009003364 | 0 |
| 64 | 7 | Ba | Ba | 152,259,786 | 154,676,607 | 2,416,822 | 0.009003364 | 0 |
| 65 | 7 | Ba | DB | 154,676,608 | 157,093,429 | 2,416,822 | 0.009003364 | 0 |
| 66 | 7 | Ba | 7 | 157,093,430 | 159,510,251 | 2,416,822 | 0.009003364 | 0 |
| 67 | 7 | Ba | TB | 159,510,252 | 161,927,073 | 2,416,822 | 0.009003364 | 0 |
| 68 | 7 | DB | – | 161,927,074 | 164,343,895 | 2,416,822 | 0.009003364 | 0 |
| 69 | 7 | DB | Ba | 164,343,896 | 166,760,717 | 2,416,822 | 0.009003364 | 0 |
| 70 | 7 | DB | DB | 166,760,718 | 169,177,539 | 2,416,822 | 0.009003364 | 0 |
| 71 | 7 | DB | 7 | 169,177,540 | 171,594,361 | 2,416,822 | 0.009003364 | 0 |
| 72 | 7 | DB | TB | 171,594,362 | 174,011,183 | 2,416,822 | 0.009003364 | 0 |
| 73 | 7 | 7 | – | 174,011,184 | 176,428,005 | 2,416,822 | 0.009003364 | 0 |
| 74 | 7 | 7 | Ba | 176,428,006 | 178,844,827 | 2,416,822 | 0.009003364 | 0 |
| 75 | 7 | 7 | DB | 178,844,828 | 181,261,649 | 2,416,822 | 0.009003364 | 0 |
| 76 | 7 | 7 | TB | 181,261,650 | 183,678,471 | 2,416,822 | 0.009003364 | 0 |
| 77 | 7 | TB | – | 183,678,472 | 186,095,293 | 2,416,822 | 0.009003364 | 0 |
| 78 | 7 | TB | Ba | 186,095,294 | 188,512,115 | 2,416,822 | 0.009003364 | 0 |
| 79 | 7 | TB | DB | 188,512,116 | 190,928,937 | 2,416,822 | 0.009003364 | 0 |
| 80 | 7 | TB | 7 | 190,928,938 | 193,345,759 | 2,416,822 | 0.009003364 | 0 |
| 81 | 7 | TB | TB | 193,345,760 | 195,762,581 | 2,416,822 | 0.009003364 | 0 |
| 82 | TB | – | – | 195,762,582 | 198,179,403 | 2,416,822 | 0.009003364 | 0 |
| 83 | TB | – | Ba | 198,179,404 | 200,596,225 | 2,416,822 | 0.009003364 | 0 |
| 84 | TB | – | DB | 200,596,226 | 203,013,047 | 2,416,822 | 0.009003364 | 0 |
| 85 | TB | – | 7 | 203,013,048 | 205,429,869 | 2,416,822 | 0.009003364 | 0 |
| 86 | TB | – | TB | 205,429,870 | 207,846,691 | 2,416,822 | 0.009003364 | 0 |
| 87 | TB | Ba | – | 207,846,692 | 210,263,513 | 2,416,822 | 0.009003364 | 0 |
| 88 | TB | Ba | 7 | 210,263,514 | 212,680,335 | 2,416,822 | 0.009003364 | 0 |

FIG. 10B

| | Reel 1 | Reel 2 | Reel 3 | Subset | | Weight | Probability | Payout |
|---|---|---|---|---|---|---|---|---|
| | | | | From | To | | | |
| 89 | TB | DB | – | 212,680,336 | 215,097,157 | 2,416,822 | 0.009003364 | 0 |
| 90 | TB | DB | 7 | 215,097,158 | 217,513,979 | 2,416,822 | 0.009003364 | 0 |
| 91 | TB | 7 | – | 217,513,980 | 219,930,801 | 2,416,822 | 0.009003364 | 0 |
| 92 | TB | 7 | Ba | 219,930,802 | 222,347,623 | 2,416,822 | 0.009003364 | 0 |
| 93 | TB | 7 | DB | 222,347,624 | 224,764,445 | 2,416,822 | 0.009003364 | 0 |
| 94 | TB | 7 | 7 | 224,764,446 | 227,181,267 | 2,416,822 | 0.009003364 | 0 |
| 95 | TB | 7 | TB | 227,181,268 | 229,598,089 | 2,416,822 | 0.009003364 | 0 |
| 96 | TB | TB | – | 229,598,090 | 232,014,911 | 2,416,822 | 0.009003364 | 0 |
| 97 | TB | TB | 7 | 232,014,912 | 234,431,733 | 2,416,822 | 0.009003364 | 0 |
| 98 | – | – | Ch | 234,431,734 | 234,685,255 | 253,522 | 0.000944443 | 3 |
| 99 | – | Ba | Ch | 234,685,256 | 234,938,777 | 253,522 | 0.000944443 | 3 |
| 100 | – | Ch | – | 234,938,778 | 235,192,299 | 253,522 | 0.000944443 | 3 |
| 101 | – | Ch | Ba | 235,192,300 | 235,445,821 | 253,522 | 0.000944443 | 3 |
| 102 | – | Ch | Ch | 235,445,822 | 236,079,627 | 633,806 | 0.002361111 | 6 |
| 103 | – | Ch | DB | 236,079,628 | 236,333,149 | 253,522 | 0.000944443 | 3 |
| 104 | – | Ch | 7 | 236,333,150 | 236,586,671 | 253,522 | 0.000944443 | 3 |
| 105 | – | Ch | TB | 236,586,672 | 236,840,193 | 253,522 | 0.000944443 | 3 |
| 106 | – | DB | Ch | 236,840,194 | 237,093,715 | 253,522 | 0.000944443 | 3 |
| 107 | – | 7 | Ch | 237,093,716 | 237,347,237 | 253,522 | 0.000944443 | 3 |
| 108 | – | TB | Ch | 237,347,238 | 237,600,759 | 253,522 | 0.000944443 | 3 |
| 109 | Ba | – | Ch | 237,600,760 | 237,854,281 | 253,522 | 0.000944443 | 3 |
| 110 | Ba | Ba | Ba | 237,854,282 | 238,804,990 | 950,709 | 0.003541667 | 20 |
| 111 | Ba | Ba | Ch | 238,804,991 | 239,058,512 | 253,522 | 0.000944443 | 3 |
| 112 | Ba | Ba | DB | 239,058,513 | 239,157,544 | 99,032 | 0.000368923 | 8 |
| 113 | Ba | Ba | TB | 239,157,545 | 239,256,576 | 99,032 | 0.000368923 | 8 |
| 114 | Ba | Ch | – | 239,256,577 | 239,510,098 | 253,522 | 0.000944443 | 3 |
| 115 | Ba | Ch | Ba | 239,510,099 | 239,763,620 | 253,522 | 0.000944443 | 3 |
| 116 | Ba | Ch | Ch | 239,763,621 | 240,397,426 | 633,806 | 0.002361111 | 6 |
| 117 | Ba | Ch | DB | 240,397,427 | 240,650,948 | 253,522 | 0.000944443 | 3 |
| 118 | Ba | Ch | 7 | 240,650,949 | 240,904,470 | 253,522 | 0.000944443 | 3 |
| 119 | Ba | Ch | TB | 240,904,471 | 241,157,992 | 253,522 | 0.000944443 | 3 |
| 120 | Ba | DB | Ba | 241,157,993 | 241,257,024 | 99,032 | 0.000368923 | 8 |
| 121 | Ba | DB | Ch | 241,257,025 | 241,510,546 | 253,522 | 0.000944443 | 3 |
| 122 | Ba | DB | DB | 241,510,547 | 241,609,578 | 99,032 | 0.000368923 | 8 |
| 123 | Ba | DB | TB | 241,609,579 | 241,708,610 | 99,032 | 0.000368923 | 8 |
| 124 | Ba | 7 | Ch | 241,708,611 | 241,962,132 | 253,522 | 0.000944443 | 3 |
| 125 | Ba | TB | Ba | 241,962,133 | 242,061,164 | 99,032 | 0.000368923 | 8 |
| 126 | Ba | TB | Ch | 242,061,165 | 242,314,686 | 253,522 | 0.000944443 | 3 |
| 127 | Ba | TB | DB | 242,314,687 | 242,413,718 | 99,032 | 0.000368923 | 8 |
| 128 | Ba | TB | TB | 242,413,719 | 242,512,750 | 99,032 | 0.000368923 | 8 |
| 129 | Ch | – | – | 242,512,751 | 242,766,272 | 253,522 | 0.000944443 | 3 |
| 130 | Ch | – | Ba | 242,766,273 | 243,019,794 | 253,522 | 0.000944443 | 3 |
| 131 | Ch | – | Ch | 243,019,795 | 243,653,600 | 633,806 | 0.002361111 | 6 |
| 132 | Ch | – | DB | 243,653,601 | 243,907,122 | 253,522 | 0.000944443 | 3 |

FIG.10c

| | Reel 1 | Reel 2 | Reel 3 | Subset | | Weight | Probability | Payout |
|---|---|---|---|---|---|---|---|---|
| | | | | From | To | | | |
| 133 | Ch | – | 7 | 243,907,123 | 244,160,644 | 253,522 | 0.000944443 | 3 |
| 134 | Ch | – | TB | 244,160,645 | 244,414,166 | 253,522 | 0.000944443 | 3 |
| 135 | Ch | Ba | – | 244,414,167 | 244,667,688 | 253,522 | 0.000944443 | 3 |
| 136 | Ch | Ba | Ba | 244,667,689 | 244,921,210 | 253,522 | 0.000944443 | 3 |
| 137 | Ch | Ba | Ch | 244,921,211 | 245,555,016 | 633,806 | 0.002361111 | 6 |
| 138 | Ch | Ba | DB | 245,555,017 | 245,808,538 | 253,522 | 0.000944443 | 3 |
| 139 | Ch | Ba | 7 | 245,808,539 | 246,062,060 | 253,522 | 0.000944443 | 3 |
| 140 | Ch | Ba | TB | 246,062,061 | 246,315,582 | 253,522 | 0.000944443 | 3 |
| 141 | Ch | Ch | – | 246,315,583 | 246,949,388 | 633,806 | 0.002361111 | 6 |
| 142 | Ch | Ch | Ba | 246,949,389 | 247,583,194 | 633,806 | 0.002361111 | 6 |
| 143 | Ch | Ch | Ch | 247,583,195 | 249,167,709 | 1,584,515 | 0.005902778 | 12 |
| 144 | Ch | Ch | DB | 249,167,710 | 249,801,515 | 633,806 | 0.002361111 | 6 |
| 145 | Ch | Ch | 7 | 249,801,516 | 250,435,321 | 633,806 | 0.002361111 | 6 |
| 146 | Ch | Ch | TB | 250,435,322 | 251,069,127 | 633,806 | 0.002361111 | 6 |
| 147 | Ch | DB | – | 251,069,128 | 251,322,649 | 253,522 | 0.000944443 | 3 |
| 148 | Ch | DB | Ba | 251,322,650 | 251,576,171 | 253,522 | 0.000944443 | 3 |
| 149 | Ch | DB | Ch | 251,576,172 | 252,209,977 | 633,806 | 0.002361111 | 6 |
| 150 | Ch | DB | DB | 252,209,978 | 252,463,499 | 253,522 | 0.000944443 | 3 |
| 151 | Ch | DB | 7 | 252,463,500 | 252,717,021 | 253,522 | 0.000944443 | 3 |
| 152 | Ch | DB | TB | 252,717,022 | 252,970,543 | 253,522 | 0.000944443 | 3 |
| 153 | Ch | 7 | – | 252,970,544 | 253,224,065 | 253,522 | 0.000944443 | 3 |
| 154 | Ch | 7 | Ba | 253,224,066 | 253,477,587 | 253,522 | 0.000944443 | 3 |
| 155 | Ch | 7 | Ch | 253,477,588 | 254,111,393 | 633,806 | 0.002361111 | 6 |
| 156 | Ch | 7 | DB | 254,111,394 | 254,364,915 | 253,522 | 0.000944443 | 3 |
| 157 | Ch | 7 | 7 | 254,364,916 | 254,618,437 | 253,522 | 0.000944443 | 3 |
| 158 | Ch | 7 | TB | 254,618,438 | 254,871,959 | 253,522 | 0.000944443 | 3 |
| 159 | Ch | TB | – | 254,871,960 | 255,125,481 | 253,522 | 0.000944443 | 3 |
| 160 | Ch | TB | Ba | 255,125,482 | 255,379,003 | 253,522 | 0.000944443 | 3 |
| 161 | Ch | TB | Ch | 255,379,004 | 256,012,809 | 633,806 | 0.002361111 | 6 |
| 162 | Ch | TB | DB | 256,012,810 | 256,266,331 | 253,522 | 0.000944443 | 3 |
| 163 | Ch | TB | 7 | 256,266,332 | 256,519,853 | 253,522 | 0.000944443 | 3 |
| 164 | Ch | TB | TB | 256,519,854 | 256,773,375 | 253,522 | 0.000944443 | 3 |
| 165 | DB | – | Ch | 256,773,376 | 257,026,897 | 253,522 | 0.000944443 | 3 |
| 166 | DB | Ba | Ba | 257,026,898 | 257,125,929 | 99,032 | 0.000368923 | 8 |
| 167 | DB | Ba | Ch | 257,125,930 | 257,379,451 | 253,522 | 0.000944443 | 3 |
| 168 | DB | Ba | DB | 257,379,452 | 257,478,483 | 99,032 | 0.000368923 | 8 |
| 169 | DB | Ba | TB | 257,478,484 | 257,577,515 | 99,032 | 0.000368923 | 8 |
| 170 | DB | Ch | – | 257,577,516 | 257,831,037 | 253,522 | 0.000944443 | 3 |
| 171 | DB | Ch | Ba | 257,831,038 | 258,084,559 | 253,522 | 0.000944443 | 3 |
| 172 | DB | Ch | Ch | 258,084,560 | 258,718,365 | 633,806 | 0.002361111 | 6 |
| 173 | DB | Ch | DB | 258,718,366 | 258,971,887 | 253,522 | 0.000944443 | 3 |
| 174 | DB | Ch | 7 | 258,971,888 | 259,225,409 | 253,522 | 0.000944443 | 3 |
| 175 | DB | Ch | TB | 259,225,410 | 259,478,931 | 253,522 | 0.000944443 | 3 |
| 176 | DB | DB | Ba | 259,478,932 | 259,577,963 | 99,032 | 0.000368923 | 8 |

FIG. 10D

| | Reel 1 | Reel 2 | Reel 3 | Subset | | Weight | Probability | Payout |
|---|---|---|---|---|---|---|---|---|
| | | | | From | To | | | |
| 177 | DB | DB | Ch | 259,577,964 | 259,831,485 | 253,522 | 0.000944443 | 3 |
| 178 | DB | DB | DB | 259,831,486 | 260,211,769 | 380,284 | 0.001416668 | 50 |
| 179 | DB | DB | TB | 260,211,770 | 260,310,801 | 99,032 | 0.000368923 | 8 |
| 180 | DB | 7 | Ch | 260,310,802 | 260,564,323 | 253,522 | 0.000944443 | 3 |
| 181 | DB | TB | Ba | 260,564,324 | 260,663,355 | 99,032 | 0.000368923 | 8 |
| 182 | DB | TB | Ch | 260,663,356 | 260,916,877 | 253,522 | 0.000944443 | 3 |
| 183 | DB | TB | DB | 260,916,878 | 261,015,909 | 99,032 | 0.000368923 | 8 |
| 184 | DB | TB | TB | 261,015,910 | 261,114,941 | 99,032 | 0.000368923 | 8 |
| 185 | 7 | – | Ch | 261,114,942 | 261,368,463 | 253,522 | 0.000944443 | 3 |
| 186 | 7 | Ba | Ch | 261,368,464 | 261,621,985 | 253,522 | 0.000944443 | 3 |
| 187 | 7 | Ch | – | 261,621,986 | 261,875,507 | 253,522 | 0.000944443 | 3 |
| 188 | 7 | Ch | Ba | 261,875,508 | 262,129,029 | 253,522 | 0.000944443 | 3 |
| 189 | 7 | Ch | Ch | 262,129,030 | 262,762,835 | 633,806 | 0.002361111 | 6 |
| 190 | 7 | Ch | DB | 262,762,836 | 263,016,357 | 253,522 | 0.000944443 | 3 |
| 191 | 7 | Ch | 7 | 263,016,358 | 263,269,879 | 253,522 | 0.000944443 | 3 |
| 192 | 7 | Ch | TB | 263,269,880 | 263,523,401 | 253,522 | 0.000944443 | 3 |
| 193 | 7 | DB | Ch | 263,523,402 | 263,776,923 | 253,522 | 0.000944443 | 3 |
| 194 | 7 | 7 | Ch | 263,776,924 | 264,030,445 | 253,522 | 0.000944443 | 3 |
| 195 | 7 | 7 | 7 | 264,030,446 | 264,030,464 | 19 | 0.000000071 | 1000000 |
| 196 | 7 | TB | Ch | 264,030,465 | 264,283,986 | 253,522 | 0.000944443 | 3 |
| 197 | TB | – | Ch | 264,283,987 | 264,537,508 | 253,522 | 0.000944443 | 3 |
| 198 | TB | Ba | Ba | 264,537,509 | 264,636,540 | 99,032 | 0.000368923 | 8 |
| 199 | TB | Ba | Ch | 264,636,541 | 264,890,062 | 253,522 | 0.000944443 | 3 |
| 200 | TB | Ba | DB | 264,890,063 | 264,989,094 | 99,032 | 0.000368923 | 8 |
| 201 | TB | Ba | TB | 264,989,095 | 265,088,126 | 99,032 | 0.000368923 | 8 |
| 202 | TB | Ch | – | 265,088,127 | 265,341,648 | 253,522 | 0.000944443 | 3 |
| 203 | TB | Ch | Ba | 265,341,649 | 265,595,170 | 253,522 | 0.000944443 | 3 |
| 204 | TB | Ch | Ch | 265,595,171 | 266,228,976 | 633,806 | 0.002361111 | 6 |
| 205 | TB | Ch | DB | 266,228,977 | 266,482,498 | 253,522 | 0.000944443 | 3 |
| 206 | TB | Ch | 7 | 266,482,499 | 266,736,020 | 253,522 | 0.000944443 | 3 |
| 207 | TB | Ch | TB | 266,736,021 | 266,989,542 | 253,522 | 0.000944443 | 3 |
| 208 | TB | DB | Ba | 266,989,543 | 267,088,574 | 99,032 | 0.000368923 | 8 |
| 209 | TB | DB | Ch | 267,088,575 | 267,342,096 | 253,522 | 0.000944443 | 3 |
| 210 | TB | DB | DB | 267,342,097 | 267,441,128 | 99,032 | 0.000368923 | 8 |
| 211 | TB | DB | TB | 267,441,129 | 267,540,160 | 99,032 | 0.000368923 | 8 |
| 212 | TB | 7 | Ch | 267,540,161 | 267,793,682 | 253,522 | 0.000944443 | 3 |
| 213 | TB | TB | Ba | 267,793,683 | 267,892,714 | 99,032 | 0.000368923 | 8 |
| 214 | TB | TB | Ch | 267,892,715 | 268,146,281 | 253,567 | 0.000944611 | 3 |
| 215 | TB | TB | DB | 268,146,282 | 268,245,313 | 99,032 | 0.000368923 | 8 |
| 216 | TB | TB | TB | 268,245,314 | 268,435,455 | 190,142 | 0.000708334 | 100 |
| | | | | | | | | |
| | | | | | | 268,435,456 | 1.000000000 | |

FIG. 10E

| | Reel 1 | Reel 2 | Reel 3 | Subset From | Subset To | Weight | Probability | Payout |
|---|---|---|---|---|---|---|---|---|
| 1 | -- | -- | -- | | | 0 | 0.000000000 | 0 |
| 2 | -- | -- | Ba | 0 | 2,441,997 | 2,441,998 | 0.009097151 | 0 |
| 3 | -- | -- | DB | 2,441,998 | 4,883,995 | 2,441,998 | 0.009097151 | 0 |
| 4 | -- | -- | 7 | 4,883,996 | 7,325,993 | 2,441,998 | 0.009097151 | 0 |
| 5 | -- | -- | TB | 7,325,994 | 9,767,991 | 2,441,998 | 0.009097151 | 0 |
| 6 | -- | Ba | -- | 9,767,992 | 12,209,989 | 2,441,998 | 0.009097151 | 0 |
| 7 | -- | Ba | Ba | 12,209,990 | 14,651,987 | 2,441,998 | 0.009097151 | 0 |
| 8 | -- | Ba | DB | 14,651,988 | 17,093,985 | 2,441,998 | 0.009097151 | 0 |
| 9 | -- | Ba | 7 | 17,093,986 | 19,535,983 | 2,441,998 | 0.009097151 | 0 |
| 10 | -- | Ba | TB | 19,535,984 | 21,977,981 | 2,441,998 | 0.009097151 | 0 |
| 11 | -- | DB | -- | 21,977,982 | 24,419,979 | 2,441,998 | 0.009097151 | 0 |
| 12 | -- | DB | Ba | 24,419,980 | 26,861,977 | 2,441,998 | 0.009097151 | 0 |
| 13 | -- | DB | DB | 26,861,978 | 29,303,975 | 2,441,998 | 0.009097151 | 0 |
| 14 | -- | DB | 7 | 29,303,976 | 31,745,973 | 2,441,998 | 0.009097151 | 0 |
| 15 | -- | DB | TB | 31,745,974 | 34,187,971 | 2,441,998 | 0.009097151 | 0 |
| 16 | -- | 7 | -- | 34,187,972 | 36,629,969 | 2,441,998 | 0.009097151 | 0 |
| 17 | -- | 7 | Ba | 36,629,970 | 39,071,967 | 2,441,998 | 0.009097151 | 0 |
| 18 | -- | 7 | DB | 39,071,968 | 41,513,965 | 2,441,998 | 0.009097151 | 0 |
| 19 | -- | 7 | 7 | 41,513,966 | 43,955,963 | 2,441,998 | 0.009097151 | 0 |
| 20 | -- | 7 | TB | 43,955,964 | 46,397,961 | 2,441,998 | 0.009097151 | 0 |
| 21 | -- | TB | -- | 46,397,962 | 48,839,959 | 2,441,998 | 0.009097151 | 0 |
| 22 | -- | TB | Ba | 48,839,960 | 51,281,957 | 2,441,998 | 0.009097151 | 0 |
| 23 | -- | TB | DB | 51,281,958 | 53,723,955 | 2,441,998 | 0.009097151 | 0 |
| 24 | -- | TB | 7 | 53,723,956 | 56,165,953 | 2,441,998 | 0.009097151 | 0 |
| 25 | -- | TB | TB | 56,165,954 | 58,607,951 | 2,441,998 | 0.009097151 | 0 |
| 26 | Ba | -- | -- | 58,607,952 | 61,049,949 | 2,441,998 | 0.009097151 | 0 |
| 27 | Ba | -- | Ba | 61,049,950 | 63,491,947 | 2,441,998 | 0.009097151 | 0 |
| 28 | Ba | -- | DB | 63,491,948 | 65,933,945 | 2,441,998 | 0.009097151 | 0 |
| 29 | Ba | -- | 7 | 65,933,946 | 68,375,943 | 2,441,998 | 0.009097151 | 0 |
| 30 | Ba | -- | TB | 68,375,944 | 70,817,941 | 2,441,998 | 0.009097151 | 0 |
| 31 | Ba | Ba | -- | 70,817,942 | 73,259,939 | 2,441,998 | 0.009097151 | 0 |
| 32 | Ba | Ba | 7 | 73,259,940 | 75,701,937 | 2,441,998 | 0.009097151 | 0 |
| 33 | Ba | DB | -- | 75,701,938 | 78,143,935 | 2,441,998 | 0.009097151 | 0 |
| 34 | Ba | DB | 7 | 78,143,936 | 80,585,933 | 2,441,998 | 0.009097151 | 0 |
| 35 | Ba | 7 | -- | 80,585,934 | 83,027,931 | 2,441,998 | 0.009097151 | 0 |
| 36 | Ba | 7 | Ba | 83,027,932 | 85,469,929 | 2,441,998 | 0.009097151 | 0 |
| 37 | Ba | 7 | DB | 85,469,930 | 87,911,927 | 2,441,998 | 0.009097151 | 0 |
| 38 | Ba | 7 | 7 | 87,911,928 | 90,353,925 | 2,441,998 | 0.009097151 | 0 |
| 39 | Ba | 7 | TB | 90,353,926 | 92,795,923 | 2,441,998 | 0.009097151 | 0 |
| 40 | Ba | TB | -- | 92,795,924 | 95,237,921 | 2,441,998 | 0.009097151 | 0 |
| 41 | Ba | TB | 7 | 95,237,922 | 97,679,919 | 2,441,998 | 0.009097151 | 0 |
| 42 | DB | -- | -- | 97,679,920 | 100,121,917 | 2,441,998 | 0.009097151 | 0 |
| 43 | DB | -- | Ba | 100,121,918 | 102,563,915 | 2,441,998 | 0.009097151 | 0 |
| 44 | DB | -- | DB | 102,563,916 | 105,005,913 | 2,441,998 | 0.009097151 | 0 |

FIG.11A

| | Reel 1 | Reel 2 | Reel 3 | Subset From | Subset To | Weight | Probability | Payout |
|---|---|---|---|---|---|---|---|---|
| 45 | DB | -- | 7 | 105,005,914 | 107,447,911 | 2,441,998 | 0.009097151 | 0 |
| 46 | DB | -- | TB | 107,447,912 | 109,889,909 | 2,441,998 | 0.009097151 | 0 |
| 47 | DB | Ba | -- | 109,889,910 | 112,331,907 | 2,441,998 | 0.009097151 | 0 |
| 48 | DB | Ba | 7 | 112,331,908 | 114,773,905 | 2,441,998 | 0.009097151 | 0 |
| 49 | DB | DB | -- | 114,773,906 | 117,215,903 | 2,441,998 | 0.009097151 | 0 |
| 50 | DB | DB | 7 | 117,215,904 | 119,657,901 | 2,441,998 | 0.009097151 | 0 |
| 51 | DB | 7 | -- | 119,657,902 | 122,099,899 | 2,441,998 | 0.009097151 | 0 |
| 52 | DB | 7 | Ba | 122,099,900 | 124,541,897 | 2,441,998 | 0.009097151 | 0 |
| 53 | DB | 7 | DB | 124,541,898 | 126,983,895 | 2,441,998 | 0.009097151 | 0 |
| 54 | DB | 7 | 7 | 126,983,896 | 129,425,893 | 2,441,998 | 0.009097151 | 0 |
| 55 | DB | 7 | TB | 129,425,894 | 131,867,891 | 2,441,998 | 0.009097151 | 0 |
| 56 | DB | TB | -- | 131,867,892 | 134,309,889 | 2,441,998 | 0.009097151 | 0 |
| 57 | DB | TB | 7 | 134,309,890 | 136,751,887 | 2,441,998 | 0.009097151 | 0 |
| 58 | 7 | -- | -- | 136,751,888 | 139,193,885 | 2,441,998 | 0.009097151 | 0 |
| 59 | 7 | -- | Ba | 139,193,886 | 141,635,883 | 2,441,998 | 0.009097151 | 0 |
| 60 | 7 | -- | DB | 141,635,884 | 144,077,881 | 2,441,998 | 0.009097151 | 0 |
| 61 | 7 | -- | 7 | 144,077,882 | 146,519,879 | 2,441,998 | 0.009097151 | 0 |
| 62 | 7 | -- | TB | 146,519,880 | 148,961,877 | 2,441,998 | 0.009097151 | 0 |
| 63 | 7 | Ba | -- | 148,961,878 | 151,403,875 | 2,441,998 | 0.009097151 | 0 |
| 64 | 7 | Ba | Ba | 151,403,876 | 153,845,873 | 2,441,998 | 0.009097151 | 0 |
| 65 | 7 | Ba | DB | 153,845,874 | 156,287,871 | 2,441,998 | 0.009097151 | 0 |
| 66 | 7 | Ba | 7 | 156,287,872 | 158,729,869 | 2,441,998 | 0.009097151 | 0 |
| 67 | 7 | Ba | TB | 158,729,870 | 161,171,867 | 2,441,998 | 0.009097151 | 0 |
| 68 | 7 | DB | -- | 161,171,868 | 163,613,865 | 2,441,998 | 0.009097151 | 0 |
| 69 | 7 | DB | Ba | 163,613,866 | 166,055,863 | 2,441,998 | 0.009097151 | 0 |
| 70 | 7 | DB | DB | 166,055,864 | 168,497,861 | 2,441,998 | 0.009097151 | 0 |
| 71 | 7 | DB | 7 | 168,497,862 | 170,939,859 | 2,441,998 | 0.009097151 | 0 |
| 72 | 7 | DB | TB | 170,939,860 | 173,381,857 | 2,441,998 | 0.009097151 | 0 |
| 73 | 7 | 7 | -- | 173,381,858 | 175,823,855 | 2,441,998 | 0.009097151 | 0 |
| 74 | 7 | 7 | Ba | 175,823,856 | 178,265,853 | 2,441,998 | 0.009097151 | 0 |
| 75 | 7 | 7 | DB | 178,265,854 | 180,707,851 | 2,441,998 | 0.009097151 | 0 |
| 76 | 7 | 7 | TB | 180,707,852 | 183,149,849 | 2,441,998 | 0.009097151 | 0 |
| 77 | 7 | TB | -- | 183,149,850 | 185,591,847 | 2,441,998 | 0.009097151 | 0 |
| 78 | 7 | TB | Ba | 185,591,848 | 188,033,845 | 2,441,998 | 0.009097151 | 0 |
| 79 | 7 | TB | DB | 188,033,846 | 190,475,843 | 2,441,998 | 0.009097151 | 0 |
| 80 | 7 | TB | 7 | 190,475,844 | 192,917,841 | 2,441,998 | 0.009097151 | 0 |
| 81 | 7 | TB | TB | 192,917,842 | 195,359,839 | 2,441,998 | 0.009097151 | 0 |
| 82 | TB | -- | -- | 195,359,840 | 197,801,837 | 2,441,998 | 0.009097151 | 0 |
| 83 | TB | -- | Ba | 197,801,838 | 200,243,835 | 2,441,998 | 0.009097151 | 0 |
| 84 | TB | -- | DB | 200,243,836 | 202,685,833 | 2,441,998 | 0.009097151 | 0 |
| 85 | TB | -- | 7 | 202,685,834 | 205,127,831 | 2,441,998 | 0.009097151 | 0 |
| 86 | TB | -- | TB | 205,127,832 | 207,569,829 | 2,441,998 | 0.009097151 | 0 |
| 87 | TB | Ba | -- | 207,569,830 | 210,011,827 | 2,441,998 | 0.009097151 | 0 |
| 88 | TB | Ba | 7 | 210,011,828 | 212,453,825 | 2,441,998 | 0.009097151 | 0 |

FIG.11B

| | Reel 1 | Reel 2 | Reel 3 | Subset From | Subset To | Weight | Probability | Payout |
|---|---|---|---|---|---|---|---|---|
| 89 | TB | DB | -- | 212,453,826 | 214,895,823 | 2,441,998 | 0.009097151 | 0 |
| 90 | TB | DB | 7 | 214,895,824 | 217,337,821 | 2,441,998 | 0.009097151 | 0 |
| 91 | TB | 7 | -- | 217,337,822 | 219,779,819 | 2,441,998 | 0.009097151 | 0 |
| 92 | TB | 7 | Ba | 219,779,820 | 222,221,817 | 2,441,998 | 0.009097151 | 0 |
| 93 | TB | 7 | DB | 222,221,818 | 224,663,815 | 2,441,998 | 0.009097151 | 0 |
| 94 | TB | 7 | 7 | 224,663,816 | 227,105,813 | 2,441,998 | 0.009097151 | 0 |
| 95 | TB | 7 | TB | 227,105,814 | 229,547,811 | 2,441,998 | 0.009097151 | 0 |
| 96 | TB | TB | -- | 229,547,812 | 231,989,809 | 2,441,998 | 0.009097151 | 0 |
| 97 | TB | TB | 7 | 231,989,810 | 234,431,807 | 2,441,998 | 0.009097151 | 0 |
| 98 | -- | -- | Ch | 234,431,808 | 234,685,329 | 253,522 | 0.000944443 | 3 |
| 99 | -- | Ba | Ch | 234,685,330 | 234,938,851 | 253,522 | 0.000944443 | 3 |
| 100 | -- | Ch | -- | 234,938,852 | 235,192,373 | 253,522 | 0.000944443 | 3 |
| 101 | -- | Ch | Ba | 235,192,374 | 235,445,895 | 253,522 | 0.000944443 | 3 |
| 102 | -- | Ch | Ch | 235,445,896 | 236,079,701 | 633,806 | 0.002361111 | 6 |
| 103 | -- | Ch | DB | 236,079,702 | 236,333,223 | 253,522 | 0.000944443 | 3 |
| 104 | -- | Ch | 7 | 236,333,224 | 236,586,745 | 253,522 | 0.000944443 | 3 |
| 105 | -- | Ch | TB | 236,586,746 | 236,840,267 | 253,522 | 0.000944443 | 3 |
| 106 | -- | DB | Ch | 236,840,268 | 237,093,789 | 253,522 | 0.000944443 | 3 |
| 107 | -- | 7 | Ch | 237,093,790 | 237,347,311 | 253,522 | 0.000944443 | 3 |
| 108 | -- | TB | Ch | 237,347,312 | 237,600,833 | 253,522 | 0.000944443 | 3 |
| 109 | Ba | -- | Ch | 237,600,834 | 237,854,355 | 253,522 | 0.000944443 | 3 |
| 110 | Ba | Ba | Ba | 237,854,356 | 238,805,064 | 950,709 | 0.003541667 | 20 |
| 111 | Ba | Ba | Ch | 238,805,065 | 239,058,586 | 253,522 | 0.000944443 | 3 |
| 112 | Ba | Ba | DB | 239,058,587 | 239,157,618 | 99,032 | 0.000368923 | 8 |
| 113 | Ba | Ba | TB | 239,157,619 | 239,256,650 | 99,032 | 0.000368923 | 8 |
| 114 | Ba | Ch | -- | 239,256,651 | 239,510,172 | 253,522 | 0.000944443 | 3 |
| 115 | Ba | Ch | Ba | 239,510,173 | 239,763,694 | 253,522 | 0.000944443 | 3 |
| 116 | Ba | Ch | Ch | 239,763,695 | 240,397,500 | 633,806 | 0.002361111 | 6 |
| 117 | Ba | Ch | DB | 240,397,501 | 240,651,022 | 253,522 | 0.000944443 | 3 |
| 118 | Ba | Ch | 7 | 240,651,023 | 240,904,544 | 253,522 | 0.000944443 | 3 |
| 119 | Ba | Ch | TB | 240,904,545 | 241,158,066 | 253,522 | 0.000944443 | 3 |
| 120 | Ba | DB | Ba | 241,158,067 | 241,257,098 | 99,032 | 0.000368923 | 8 |
| 121 | Ba | DB | Ch | 241,257,099 | 241,510,620 | 253,522 | 0.000944443 | 3 |
| 122 | Ba | DB | DB | 241,510,621 | 241,609,652 | 99,032 | 0.000368923 | 8 |
| 123 | Ba | DB | TB | 241,609,653 | 241,708,684 | 99,032 | 0.000368923 | 8 |
| 124 | Ba | 7 | Ch | 241,708,685 | 241,962,206 | 253,522 | 0.000944443 | 3 |
| 125 | Ba | TB | Ba | 241,962,207 | 242,061,238 | 99,032 | 0.000368923 | 8 |
| 126 | Ba | TB | Ch | 242,061,239 | 242,314,760 | 253,522 | 0.000944443 | 3 |
| 127 | Ba | TB | DB | 242,314,761 | 242,413,792 | 99,032 | 0.000368923 | 8 |
| 128 | Ba | TB | TB | 242,413,793 | 242,512,824 | 99,032 | 0.000368923 | 8 |
| 129 | Ch | -- | -- | 242,512,825 | 242,766,346 | 253,522 | 0.000944443 | 3 |
| 130 | Ch | -- | Ba | 242,766,347 | 243,019,868 | 253,522 | 0.000944443 | 3 |
| 131 | Ch | -- | Ch | 243,019,869 | 243,653,674 | 633,806 | 0.002361111 | 6 |
| 132 | Ch | -- | DB | 243,653,675 | 243,907,196 | 253,522 | 0.000944443 | 3 |

FIG. 11C

| | Reel 1 | Reel 2 | Reel 3 | Subset From | Subset To | Weight | Probability | Payout |
|---|---|---|---|---|---|---|---|---|
| 133 | Ch | -- | 7 | 243,907,197 | 244,160,718 | 253,522 | 0.000944443 | 3 |
| 134 | Ch | -- | TB | 244,160,719 | 244,414,240 | 253,522 | 0.000944443 | 3 |
| 135 | Ch | Ba | -- | 244,414,241 | 244,667,762 | 253,522 | 0.000944443 | 3 |
| 136 | Ch | Ba | Ba | 244,667,763 | 244,921,284 | 253,522 | 0.000944443 | 3 |
| 137 | Ch | Ba | Ch | 244,921,285 | 245,555,090 | 633,806 | 0.002361111 | 6 |
| 138 | Ch | Ba | DB | 245,555,091 | 245,808,612 | 253,522 | 0.000944443 | 3 |
| 139 | Ch | Ba | 7 | 245,808,613 | 246,062,134 | 253,522 | 0.000944443 | 3 |
| 140 | Ch | Ba | TB | 246,062,135 | 246,315,656 | 253,522 | 0.000944443 | 3 |
| 141 | Ch | Ch | -- | 246,315,657 | 246,949,462 | 633,806 | 0.002361111 | 6 |
| 142 | Ch | Ch | Ba | 246,949,463 | 247,583,268 | 633,806 | 0.002361111 | 6 |
| 143 | Ch | Ch | Ch | 247,583,269 | 249,167,783 | 1,584,515 | 0.005902778 | 12 |
| 144 | Ch | Ch | DB | 249,167,784 | 249,801,589 | 633,806 | 0.002361111 | 6 |
| 145 | Ch | Ch | 7 | 249,801,590 | 250,435,395 | 633,806 | 0.002361111 | 6 |
| 146 | Ch | Ch | TB | 250,435,396 | 251,069,201 | 633,806 | 0.002361111 | 6 |
| 147 | Ch | DB | -- | 251,069,202 | 251,322,723 | 253,522 | 0.000944443 | 3 |
| 148 | Ch | DB | Ba | 251,322,724 | 251,576,245 | 253,522 | 0.000944443 | 3 |
| 149 | Ch | DB | Ch | 251,576,246 | 252,210,051 | 633,806 | 0.002361111 | 6 |
| 150 | Ch | DB | DB | 252,210,052 | 252,463,573 | 253,522 | 0.000944443 | 3 |
| 151 | Ch | DB | 7 | 252,463,574 | 252,717,095 | 253,522 | 0.000944443 | 3 |
| 152 | Ch | DB | TB | 252,717,096 | 252,970,617 | 253,522 | 0.000944443 | 3 |
| 153 | Ch | 7 | -- | 252,970,618 | 253,224,139 | 253,522 | 0.000944443 | 3 |
| 154 | Ch | 7 | Ba | 253,224,140 | 253,477,661 | 253,522 | 0.000944443 | 3 |
| 155 | Ch | 7 | Ch | 253,477,662 | 254,111,467 | 633,806 | 0.002361111 | 6 |
| 156 | Ch | 7 | DB | 254,111,468 | 254,364,989 | 253,522 | 0.000944443 | 3 |
| 157 | Ch | 7 | 7 | 254,364,990 | 254,618,511 | 253,522 | 0.000944443 | 3 |
| 158 | Ch | 7 | TB | 254,618,512 | 254,872,033 | 253,522 | 0.000944443 | 3 |
| 159 | Ch | TB | -- | 254,872,034 | 255,125,555 | 253,522 | 0.000944443 | 3 |
| 160 | Ch | TB | Ba | 255,125,556 | 255,379,077 | 253,522 | 0.000944443 | 3 |
| 161 | Ch | TB | Ch | 255,379,078 | 256,012,883 | 633,806 | 0.002361111 | 6 |
| 162 | Ch | TB | DB | 256,012,884 | 256,266,405 | 253,522 | 0.000944443 | 3 |
| 163 | Ch | TB | 7 | 256,266,406 | 256,519,927 | 253,522 | 0.000944443 | 3 |
| 164 | Ch | TB | TB | 256,519,928 | 256,773,449 | 253,522 | 0.000944443 | 3 |
| 165 | DB | -- | Ch | 256,773,450 | 257,026,971 | 253,522 | 0.000944443 | 3 |
| 166 | DB | Ba | Ba | 257,026,972 | 257,126,003 | 99,032 | 0.000368923 | 8 |
| 167 | DB | Ba | Ch | 257,126,004 | 257,379,525 | 253,522 | 0.000944443 | 3 |
| 168 | DB | Ba | DB | 257,379,526 | 257,478,557 | 99,032 | 0.000368923 | 8 |
| 169 | DB | Ba | TB | 257,478,558 | 257,577,589 | 99,032 | 0.000368923 | 8 |
| 170 | DB | Ch | -- | 257,577,590 | 257,831,111 | 253,522 | 0.000944443 | 3 |
| 171 | DB | Ch | Ba | 257,831,112 | 258,084,633 | 253,522 | 0.000944443 | 3 |
| 172 | DB | Ch | Ch | 258,084,634 | 258,718,439 | 633,806 | 0.002361111 | 6 |
| 173 | DB | Ch | DB | 258,718,440 | 258,971,961 | 253,522 | 0.000944443 | 3 |
| 174 | DB | Ch | 7 | 258,971,962 | 259,225,483 | 253,522 | 0.000944443 | 3 |
| 175 | DB | Ch | TB | 259,225,484 | 259,479,005 | 253,522 | 0.000944443 | 3 |
| 176 | DB | DB | Ba | 259,479,006 | 259,578,037 | 99,032 | 0.000368923 | 8 |

FIG.11D

| | Reel 1 | Reel 2 | Reel 3 | Subset From | Subset To | Weight | Probability | Payout |
|---|---|---|---|---|---|---|---|---|
| 177 | DB | DB | Ch | 259,578,038 | 259,831,559 | 253,522 | 0.000944443 | 3 |
| 178 | DB | DB | DB | 259,831,560 | 260,211,843 | 380,284 | 0.001416668 | 50 |
| 179 | DB | DB | TB | 260,211,844 | 260,310,875 | 99,032 | 0.000368923 | 8 |
| 180 | DB | 7 | Ch | 260,310,876 | 260,564,397 | 253,522 | 0.000944443 | 3 |
| 181 | DB | TB | Ba | 260,564,398 | 260,663,429 | 99,032 | 0.000368923 | 8 |
| 182 | DB | TB | Ch | 260,663,430 | 260,916,951 | 253,522 | 0.000944443 | 3 |
| 183 | DB | TB | DB | 260,916,952 | 261,015,983 | 99,032 | 0.000368923 | 8 |
| 184 | DB | TB | TB | 261,015,984 | 261,115,015 | 99,032 | 0.000368923 | 8 |
| 185 | 7 | -- | Ch | 261,115,016 | 261,368,537 | 253,522 | 0.000944443 | 3 |
| 186 | 7 | Ba | Ch | 261,368,538 | 261,622,059 | 253,522 | 0.000944443 | 3 |
| 187 | 7 | Ch | -- | 261,622,060 | 261,875,581 | 253,522 | 0.000944443 | 3 |
| 188 | 7 | Ch | Ba | 261,875,582 | 262,129,103 | 253,522 | 0.000944443 | 3 |
| 189 | 7 | Ch | Ch | 262,129,104 | 262,762,909 | 633,806 | 0.002361111 | 6 |
| 190 | 7 | Ch | DB | 262,762,910 | 263,016,431 | 253,522 | 0.000944443 | 3 |
| 191 | 7 | Ch | 7 | 263,016,432 | 263,269,953 | 253,522 | 0.000944443 | 3 |
| 192 | 7 | Ch | TB | 263,269,954 | 263,523,475 | 253,522 | 0.000944443 | 3 |
| 193 | 7 | DB | Ch | 263,523,476 | 263,776,997 | 253,522 | 0.000944443 | 3 |
| 194 | 7 | 7 | Ch | 263,776,998 | 264,030,519 | 253,522 | 0.000944443 | 3 |
| 195 | 7 | 7 | 7 | 264,030,520 | 264,030,538 | 19 | 0.000000071 | 1000000 |
| 196 | 7 | TB | Ch | 264,030,539 | 264,284,060 | 253,522 | 0.000944443 | 3 |
| 197 | TB | -- | Ch | 264,284,061 | 264,537,582 | 253,522 | 0.000944443 | 3 |
| 198 | TB | Ba | Ba | 264,537,583 | 264,636,614 | 99,032 | 0.000368923 | 8 |
| 199 | TB | Ba | Ch | 264,636,615 | 264,890,136 | 253,522 | 0.000944443 | 3 |
| 200 | TB | Ba | DB | 264,890,137 | 264,989,168 | 99,032 | 0.000368923 | 8 |
| 201 | TB | Ba | TB | 264,989,169 | 265,088,200 | 99,032 | 0.000368923 | 8 |
| 202 | TB | Ch | -- | 265,088,201 | 265,341,722 | 253,522 | 0.000944443 | 3 |
| 203 | TB | Ch | Ba | 265,341,723 | 265,595,244 | 253,522 | 0.000944443 | 3 |
| 204 | TB | Ch | Ch | 265,595,245 | 266,229,050 | 633,806 | 0.002361111 | 6 |
| 205 | TB | Ch | DB | 266,229,051 | 266,482,572 | 253,522 | 0.000944443 | 3 |
| 206 | TB | Ch | 7 | 266,482,573 | 266,736,094 | 253,522 | 0.000944443 | 3 |
| 207 | TB | Ch | TB | 266,736,095 | 266,989,616 | 253,522 | 0.000944443 | 3 |
| 208 | TB | DB | Ba | 266,989,617 | 267,088,648 | 99,032 | 0.000368923 | 8 |
| 209 | TB | DB | Ch | 267,088,649 | 267,342,170 | 253,522 | 0.000944443 | 3 |
| 210 | TB | DB | DB | 267,342,171 | 267,441,202 | 99,032 | 0.000368923 | 8 |
| 211 | TB | DB | TB | 267,441,203 | 267,540,234 | 99,032 | 0.000368923 | 8 |
| 212 | TB | 7 | Ch | 267,540,235 | 267,793,756 | 253,522 | 0.000944443 | 3 |
| 213 | TB | TB | Ba | 267,793,757 | 267,892,788 | 99,032 | 0.000368923 | 8 |
| 214 | TB | TB | Ch | 267,892,789 | 268,146,310 | 253,522 | 0.000944443 | 3 |
| 215 | TB | TB | DB | 268,146,311 | 268,245,342 | 99,032 | 0.000368923 | 8 |
| 216 | TB | TB | TB | 268,245,343 | 268,435,455 | 190,113 | 0.000708226 | 100 |
| | | | | | | 268,435,456 | 1.000000000 | |

FIG.11E

REEL TYPE SLOT MACHINE UTILIZING TIME-BASED RANDOM GAME RESULT SELECTION MEANS

This is a continuation-in-part of U.S. application Ser. No. 08/876,046, filed Jun. 13, 1997.

BACKGROUND OF THE INVENTION

The present invention relates to reel-type slot machines, and more particularly to reel-type slot machines having multiple display reels each bearing a plurality of different game symbols, wherein the reels are driven to display game symbols corresponding to a game result randomly selected from repetitive sets of potential game results.

In recent years reel-type slot machines have evolved from mechanical type machines wherein mechanical clutches were relied on to stop spinning display reels at random locations to display a game result, to electronic type machines wherein a microprocessor randomly selects a game result, and the display reels are driven to reel positions wherein game symbols on the reels display the game result. The present invention is directed to an improvement in such an electronic type slot machine wherein a game result is randomly selected from repetitive sets of potential game results, and wherein the number of occurrences of a game result within the set determines the probability of that game result being selected. After selection of the game result, the reels are positioned to display the game symbols associated with the selected result.

In electronic reel type slot machines the reels are typically positioned by stepper motors, which may be contained in removable modules within the machine. The stepper motors respond to applied signals which are progressively phase-shifted relative to each other such that the stepper motors are caused to turn one element of rotation for each progression of the phase signals.

The phase signals are typically generated in motor drive circuits, which respond to applied motor stepping pulses to advance the reels in increments. The motor stepping pulses are generated by a microprocessor, a predetermined number of pulses being applied to the motor drive circuits to cause each motor to be incremented to a selected stopping position wherein the game result is displayed by the display reels. In prior slot machine designs, the stopping positions were typically determined by the microprocessor by either counting the number of motor pulses occurring after a "home" marker on the reel had passed a fixed sensor, or by counting markers provided on the reel for each symbol position after the home marker had passed.

In contrast, the present invention is directed to a reel-type slot machine wherein in response to a play command a random game result is selected, and the display reels are rotated to display the game symbols associated with that result.

Accordingly, it is a general object of the present invention to provide a new and improved reel-type slot machine.

It is a more specific object of the present invention to provide a reel-type slot machine wherein upon play a game result is randomly selected, and the display reels are driven by stepper motors to display the game symbols associated with the game result.

It is a still more specific object of the present invention to provide a reel-type slot machine wherein the game result is randomly selected from a repetitive set of potential game results, the number of occurrences of a game result in the set determining the probability of occurrence of the game result, and the reels are positioned to display the game symbols associated with the selected game result.

SUMMARY OF THE INVENTION

The invention is directed to a reel-type slot machine comprising a user-actuated spin switch for providing a play command, at least one display reel having a plurality of different game symbols thereon, the display reel being rotatably mounted to selectively display one of the game symbols, reel drive means responsive to the play command for rotatably driving the display reel, selection means responsive to the play command for randomly selecting one game result from a predetermined set of potential game results, the game result having an associated game symbol for display by the display reel, and display control means for causing the reel drive means to position the reel to display the associated game symbol.

The invention is further directed to a reel-type slot machine comprising a user actuated spin switch for providing a spin command, a plurality of display reels each having a plurality of different game symbols thereon, the display reels each being rotatably mounted to selectively display one of the game symbols, a plurality of reel drive means each responsive to the spin command for rotatably driving the display reels, selection means responsive to the play command for randomly selecting one game result from a predetermined set of potential game results, the game result having a plurality of associated game symbols for display by respective ones of the display reels, and display control means for causing the reel drive means to position the reels to display the game symbols associated with the selected game result.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 1 is a perspective view of a reel-type slot machine constructed in accordance with the invention.

FIG. 2 is a perspective view of the slot machine of FIG. 1 with its cabinet open to show the principal components of the machine.

FIG. 3 is a perspective view of one of the removable reel assemblies utilized in the slot machine of FIGS. 1 and 2.

FIGS. 10A–10E depict a table showing the association between random numbers and game results in the slot machine of FIGS. 1 and 2.

FIGS. 11A–11E depict a table similar to that of FIGS. 10A–10E wherein the probability of occurrence of an undesired game result has been reduced to zero.

DESCRIPTION OF THE PREFERRED EMBODIMENT

Figure 4:
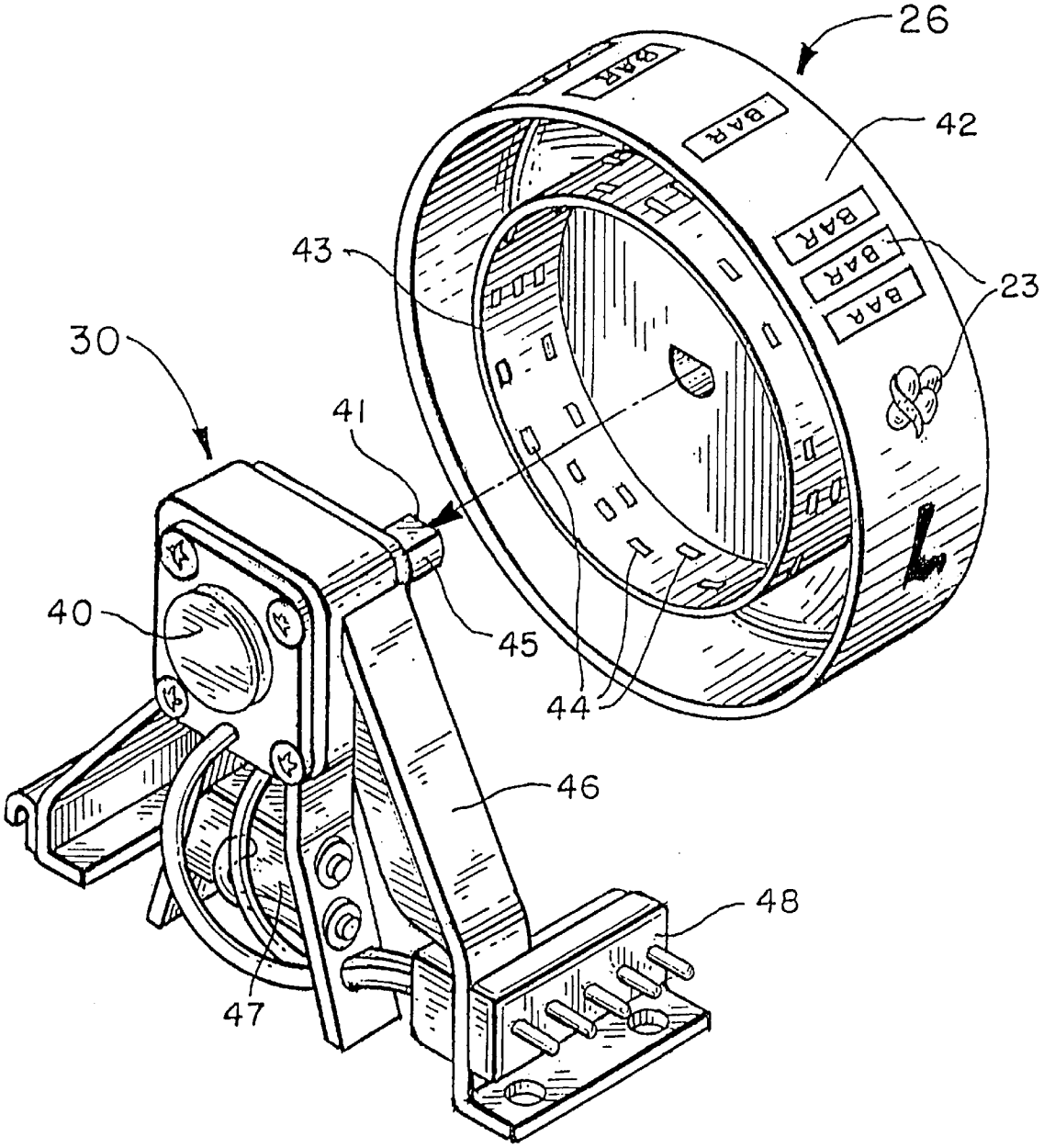
FIG. 4 is an enlarged exploded view of the reel assembly of FIG. 3.

Referring to the drawings, and particularly to FIGS. 1 and 2, a reel-type slot machine 20 constructed in accordance with the invention is seen to include a cabinet 21 having a display window 22. Game symbols 23–25 contained on respective reels 26–28 (FIG. 2) of individual plug-in reel assemblies 30–32 are visible on a pay line 29 through the window. It will be understood that the slot machine can he constructed with a greater or lesser number of display reels.

In accordance with conventional design slot machine 20 includes a coin slot 33 (FIG. 1) for receiving coins, a tray 34 for dispensing coins, and a user-actuated play handle 35 for initiating game play. Within cabinet 21 slot machine 20 further includes a coin dispensing unit 36 (FIG. 2) of conventional design and an electronic game control module 37 for controlling game operation. As will be described presently, this module among its other control functions provides drive signals to reel assemblies 30–32 to cause reels 26–28 to display game symbols corresponding to a particular game result on pay line 29.

Referring to FIGS. 3–6, reel assembly 30, which may be identical to the other reel assemblies except possibly for its symbol make-up, is seen to include a stepper motor 40 having a shaft 41 on which display reel 26 is received. The reel includes an outer rim portion 42 on which game symbols 23 are contained, and an inner rim portion 43 concentric with the outer portion on which symbol-indicating indicia in the form of a plurality of apertures 44 are arranged side-by-side in three columns. The two reel portions 42 and 43 are carried on shaft 41 at a fixed angular position relative to each other. In a preferred form, the entire display reel 26 is formed as a single piece which can be conveniently installed on and removed from shaft 41. A flat 45 may be formed on shaft 41 to provide positive rotational coupling between stepper motor 40 and the reel.

A generally A-shaped frame 46 is provided to position motor 40 such that one symbol position on the outer rim portion 42 can be seen on pay line 29 through window 22 when reel assembly 30 is installed in cabinet 21. A detector assembly 47 on frame 46 operates in conjunction with the indicia 44 on the inner rim portion 43 to identify the game symbols as they approach window 22. An electrical connector 48 is provided on one leg of frame 46 to enable electrical connections to be made with the reel assembly when the reel assembly is installed in cabinet 21.

Figure 6:
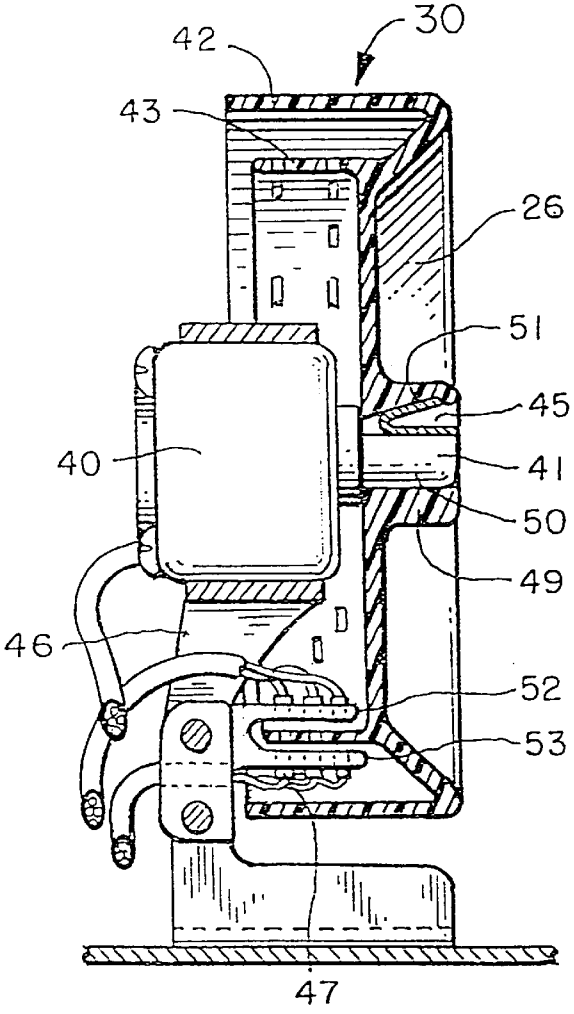
FIG. 6 is a side cross-sectional view of the reel assembly taken along line 6—6 of FIG. 5.
Figure 5:
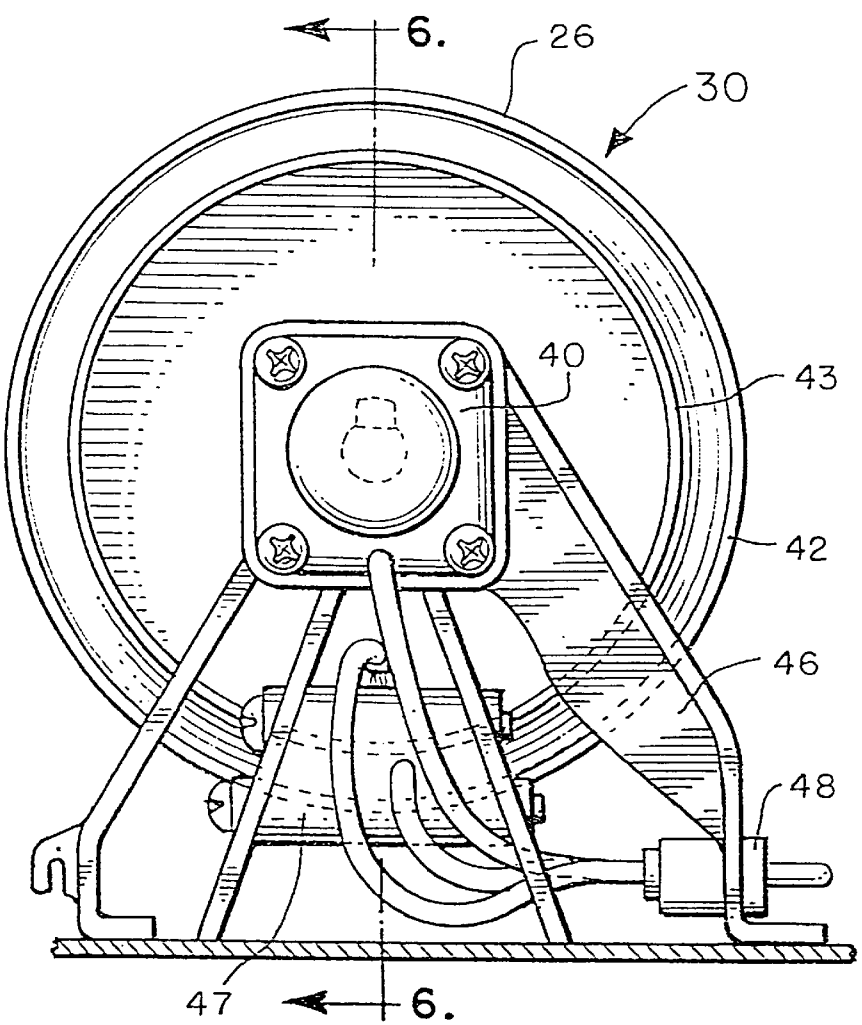
FIG. 5 is an enlarged front view of the reel assembly of FIGS. 3 and 4.

As shown in FIG. 6, reel 26 includes a hub portion 49 which is received over motor shaft 41. An aperture 50 in the hub portion receives the motor shaft. A spring 51 within the hub portion engages the flat 45 on the shaft to secure the hub on the shaft, and prevent independent reel rotation. Alternatively, a set screw may be provided in the hub portion for the same purpose.

Detector assembly 47 is seen in FIG. 6 to include a housing having two projecting portions 52 and 53 which form a slot 54 through which the inner rim portion 43 passes. The upper portion 52 includes three light sources in the form of LEDs 55*a*–55*c* and the lower portion 53 includes three photodetectors 56*a*–56*c*. LEDs 55*a*–55*c* and detectors 56*a*–56*c* are aligned with rim portion 43 such that the three columns of symbol-indicating apertures 44 contained thereon pass between respective paired LEDs and detectors with rotation of the reel. In this way, the passage of each set of apertures is sensed, and, in a manner to be explained, the game control circuits determine when a particular game symbol is about to be displayed in window 22.

Figure 7:
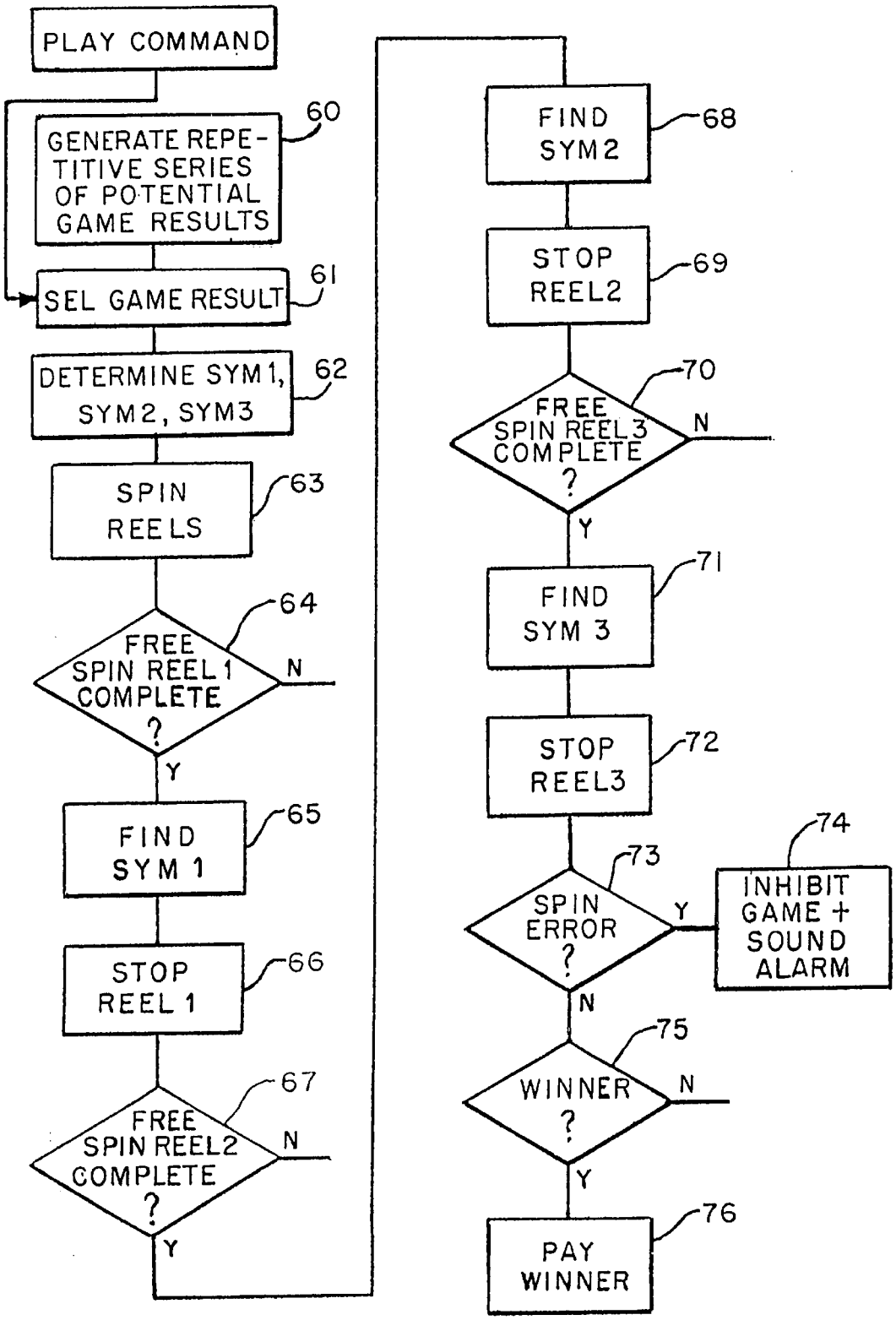
FIG. 7 is a functional block diagram illustrating the operation of the slot machine of FIGS. 1 and 2.

The basic operation of slot machine 20 is functionally illustrated in FIG. 7. First, a series of potential game results is rapidly repetitively generated at 60. Then, if the machine has not been inhibited as a result of a malfunction or tampering, the microprocessor-driven game control circuits, upon receipt of a play command, either as a result of the player depositing a coin or actuating a spin switch, select the then existing potential game result at 61. Next, at 62 this number is utilized in conjunction with a stored look-up table in an EPROM or similar memory device to provide a game result comprising, in this three reel embodiment, three game symbols SYM1, SYM2 and SYM3.

Next, at 63 all three reels are caused to spin. The first reel 26 continues to spin for a first predetermined free spin period, typically one second, and upon completion of this period at 64 a stopping procedure is initiated at 65 whereby signals developed by the game symbol-indicating apertures 44 passing detector 47 are compared with signals corresponding to the desired game symbol SYM1. When a comparison is realized, the application of normal drive signals to stepper motor 40 is interrupted and a stop routine is initiated at 66 to stop the display reel with the desired symbol displayed.

In the meantime the second display reel 27 continues to spin, and upon completion of a second predetermined spin period, also typically one second, at 67 following the stopping of reel 26 the signals generated by the symbol-indicating apertures on reel 2 are compared at 68 with signals corresponding to the desired game symbol SYM2 for reel 27, and upon occurrence of a comparison a stop routine is initiated at 69 to cause reel 27 to stop with the desired game symbol for that reel displayed. Similarly, the third display reel 28 continues to spin through a third one second predetermined free spin period at 70 following the stopping of reel 27 until at 71 a comparison of the signals generated by the symbol-indicating apertures 44 thereon with a signal corresponding to the desired symbol to be displayed on the reel is obtained and a stop routine 72 causes the reel to stop with the intended game symbol displayed through window 22 on pay line 29.

In the event that a spin error has occurred in the positioning of any one of the three reels, either as a result of the stepper motor slipping or failing to step in response to a stepper pulse, or a reel having been moved in the absence of stepper pulses, the monitoring system signals a spin error at 73, an alarm is sounded and the game is inhibited at 74. In the absence of a spin error, a determination is made at 75 whether the game results constitute a win, and if so the hopper mechanism 36 is actuated to accomplish a payout at 76.

Figure 8:
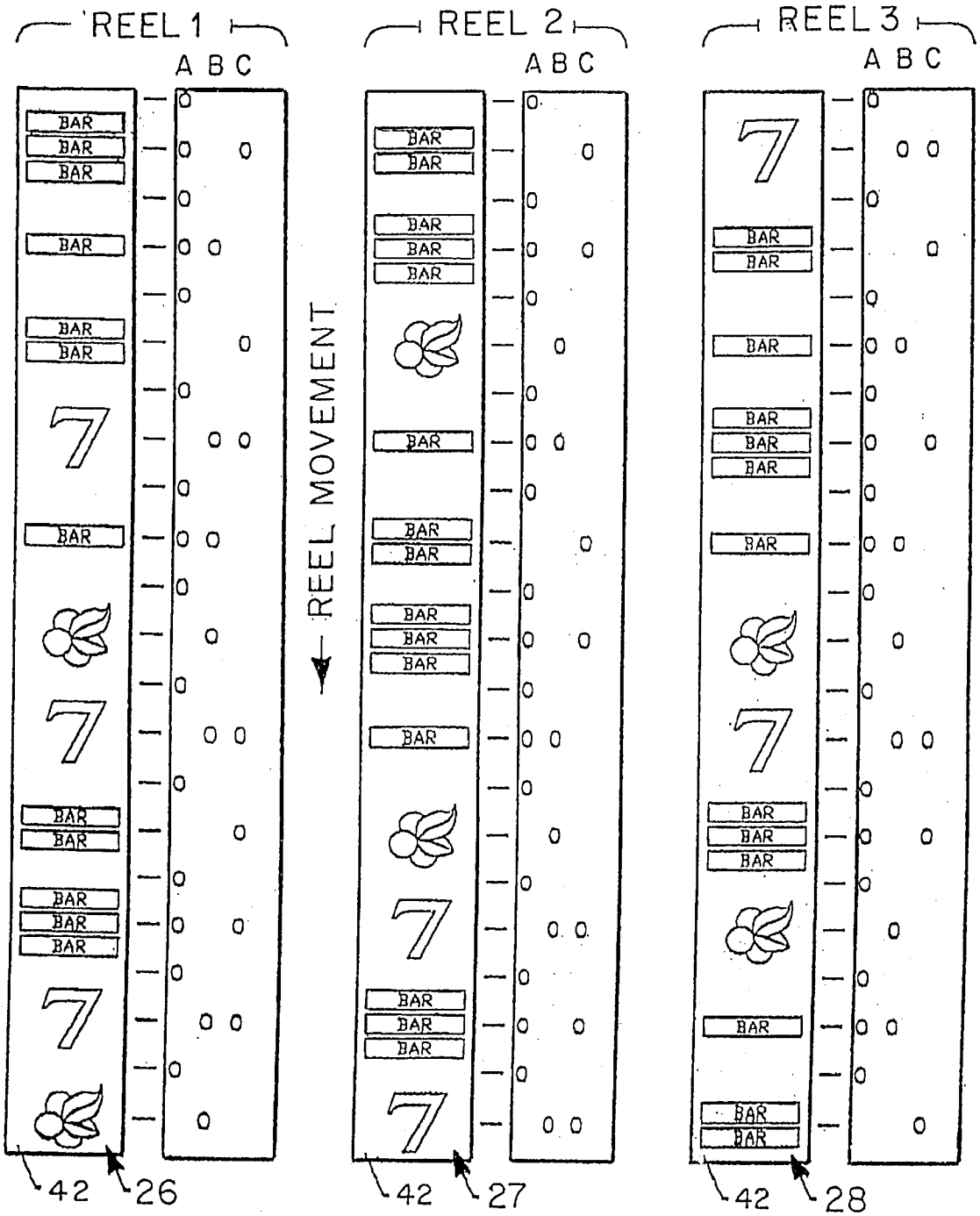
FIG. 8 is an illustration of a representative arrangement of game symbols and game symbol-indicating indicia on the three display reels of the slot machine of FIGS. 1 and 2.

One form of display reel make-up is shown in FIG. 8. Here each of the three display reels 26–28 has 22 display positions, containing 11 blank symbols and 11 non-blank symbols. The symbols appear on the outer rim portions 42 of the reels in alternation, a blank symbol appearing between each pair of consecutive non-blank game symbols.

Indicia comprising a three bit binary code is associated with each symbol by the provision of thin slit-shaped apertures on the inner rim portion 43 of each display reel. These binary codes are unique to their associated symbol or blank, and are arranged in three columns A–C around the reel rim portions 43.

Although for clarity no angular displacement is shown between the symbols and their associated codes, in practice the angular displacement of the leading edge of the codes to the symbols may range from 0° to 180°, depending on the location of sensors 47 relative to the pay line, and on the angular rotation required to stop the reel. In the illustrated embodiment, for example, where the sensors are displaced 115° from the pay line, if the stepper motor is large and requires a relatively small number of steps per rotation, 48 for example, the stop is essentially instantaneous and the displacement is 115°. However, if a ramp down procedure such as that to be later described is used, and the ramp-down routine requires, for example, 40° of rotation, the displacement is 155° (115°+40°).

While the illustrated reel set shows 22 symbol positions with 11 blank game symbols and 11 non-blank game symbols of 6 different types (e.g., for reel 30; two triple bars, two double bars, two single bars, two cherries, 3 sevens), it will be appreciated that a greater or lesser number of symbol positions can be provided with a greater or lesser number of symbols and symbol types.

Figure 9:
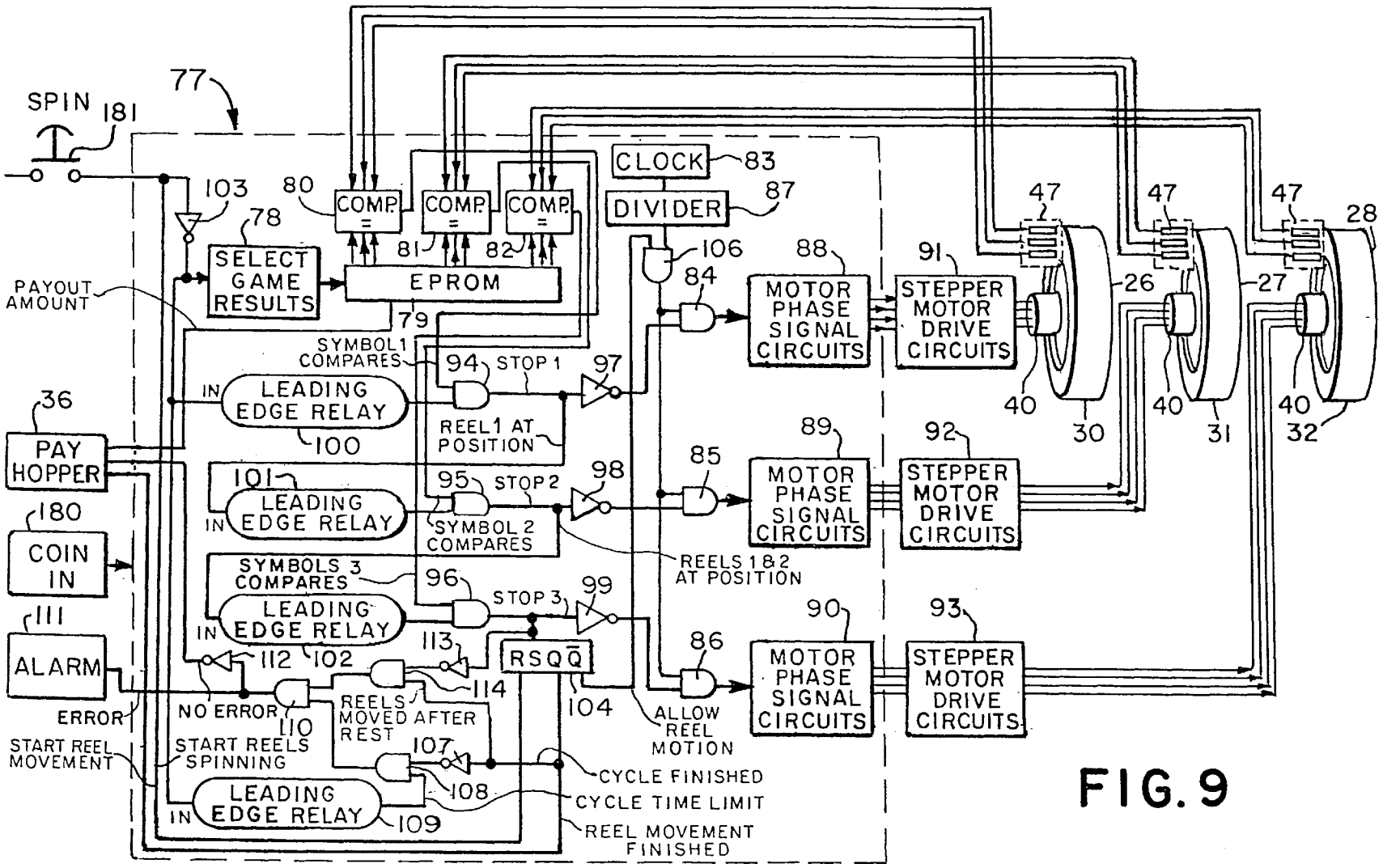
FIG. 9 is a simplified schematic diagram partly in functional form illustrating the operation of the slot machine of FIGS. 1 and 2.

The functioning of slot machine 20 is illustrated in FIG. 9. Game control circuits 37 (FIG. 2), which typically include a microprocessor and associated memory and input-output circuits depicted functionally in FIG. 9 as game circuits 77, receive signals from a conventional coin-in detector 180 and a conventional spin switch 181, which may be either a panel-mounted push button switch or a switch actuated by play handle 35. The microprocessor, the function of which is generally designated in FIG. 9 by a game results select circuit 78, randomly selects a number from 1–216, representing a selected game result from the 216 game results possible with the three reels configured with symbols as previously described. This number is applied to a memory device 79, preferably taking the form of an EPROM 79, in which a look-up table has been stored.

The look-up table contains specific game symbols to be displayed (blank, 7, bar, double bar, triple bar, or cherry) by each reel for the selected game result. The game result display symbols are separately output from the EPROM as three bit binary signals which are applied to a respective ones of three comparators 80–82.

When enabling signals are applied to AND gates 84–86, stepper pulses generated by a clock 83 and a divider 87 are applied to individual motor phase signal generating circuits 88–90 associated with reel assemblies 30–32, respectively. Circuits 88–90 provide progressively advancing quadrature phase signals in response to the applied stepper pulses to stepper motor drive circuits 91–93, respectively. The outputs of each drive circuit are applied to the four stator windings of the associated stepper motor 40 in a conventional manner whereby the stepper motor is caused to incrementally rotate in response to each stepper pulse.

As display reels 26–28 rotate the detectors 47 associated with each reel read the game symbol-indicating apertures 44 on the reels. Upon completion of the respective free spin periods of the reels, signals developed by detectors 47 from the passing apertures 44 are compared in comparators 80–82 with signals corresponding to the desired game result symbols, as supplied to those comparators by the look-up table in EPROM 79. When a comparison is realized, an inhibit signal is applied by the corresponding comparator through respective ones of AND gates 94–96 and invertors 97–99 to AND gates 84–86, respectively, the application of normal stepper pulses to the corresponding one of motor phase signal circuits 88–90 is interrupted, and the corresponding reel is stopped, either abruptly by force of the motor or by a ramp-down procedure to be described. Once the reels have stopped, if the game result for the generated random number is a win, an appropriate signal indicative of the pay-out amount is generated by EPROM 79 and applied to hopper mechanism 36 to pay out the appropriate number of coins.

It will be understood that each of the reel assemblies, except for the symbol make-up of their individual reels 26–28, which may or may not be the same, may be identical in construction and operation. Similarly, each of the three motor drive circuits 91–93 may be identical in structure and operation.

To achieve the necessary free-spin periods for reels 26–28, game control circuits 77 include three delay circuits 100–102. Delay circuit 100, which is triggered by actuation of spin switch 181 through an inverter 103, may provide a delay, for example, of approximately one second. During this delay period AND gate 94 is inhibited by the delay circuit, preventing the application of a stop signal from comparator 80 to AND gate 84 through inverter 97. Delay circuit 101, which is triggered by the stop signal at the output of AND gate 94, similarly prevents the output of comparator 81 from inhibiting AND gate 85 through inverter 98 for approximately one second following the stopping of display reel 26. Delay circuit 102 in like manner prevents the output of comparator 82 from inhibiting AND gate 86 for one second following the stopping of display reel 27.

Protection against tampering or malfunction is provided by an RS flip-flop 104 which is set by the output of AND gate 96 when the third reel 28 comes to rest. The $\overline{Q}$ output of this flip-flop is applied to an AND gate 106, which inhibits the application of stepper pulses to the motor phase signal circuits. The Q output of RS flip-flop 104 is applied through an inverter 107 to a NAND gate 108, which also receives the output of a delay circuit 109 triggered by spin switch 181. In the event the reels have not comes to rest within the time period established by delay circuit 109, NAND gate 108 produces an output which is applied through NAND gate 110 to an alarm circuit 111 and through an inverter 112 to an inhibiting input of coin hopper 36.

Further protection against tampering is provided by an inverter 113 and NAND gate 114, which provide an alarm output through NAND gate 110 if the reels are moved after the reels have stopped and RS flip-flop 104 is set.

While control circuits 77 have been shown and explained in terms of certain logic components, it will be appreciated that the same functionality can be readily obtained by means of a conventional microprocessor using well known programming techniques. For example, in the present embodiment all the functions of circuits 77 can be accomplished using, for example, a type ATMEL 89C2051 microprocessor in conjunction with an appropriate EPROM and conventional and well known peripheral components. Furthermore, while a three reel machine is shown, one or more additional reels can be provided utilizing the control methods described for reels 26–28.

A table illustrating the 216 potential game results for a representative slot machine having the five different non-blank symbols is shown in FIGS. 10A–10E. Referring to these Figures, it is seen that 216 different combinations of the symbols on three reels, i.e., 216 different game results, are possible. The probability of selection of each of the different game results is dependent on its time window of availability, which in turn is dependent on its weight, or the number of times it appears within the set of potential gate results. In this case there are 268,435,455 game results in the set which may for convenience be sequentially numbered with the repeated game results being designated as subsets.

Certain winning combinations of symbols (such as "777") are given a low probability and a high payout. Losing combinations may be given a high probability. In the illustrated table, for example, the first 97 losing game results have the same size subset (2,416,822) and hence the same probability of occurrence (0.009003364) and same zero payout. Winning game results in the table, depending on the particular symbols being displayed, have lesser probabilities. For example, game result 143, which displays three cherries, has a subset or weight of 1,584,515 possibilities, a probability of occurrence of 0.005902778, and a payout of 12 times the bet. Game result 195, the "777" jackpot, has a subset with a weight of 19, a probability of occurrence of 0.000000071, and a payout of 1,000,000 times the bet.

As shown in FIGS. 11A–11E, it is also possible to completely omit one or more undesirable game results by reducing the occurrence of that game result in the set of potential game results to zero. For example, the 3 blanks corresponding to game result 1 in FIGS. 10A–10E may be eliminated by reducing the subset from a weight of 2,416,822 to a weight of 0. The weight of this combination is spread proportionately across the other 96 losing combinations.

This adds to the enjoyment of the user, since he always sees at least one symbol, even if a losing combination. The probability of other undesirable losing results may similarly be reduced or eliminated. For example, the appearance of a blank on the first reel, or on the first and second reels, which would cause the player to give up prior to completion of play, may be avoided.

Thus, the ability to control the number of occurrences of a particular game result in the generated set of game results provides the game designer a high degree of flexibility. By varying the size of a subset of random numbers which will give a particular game result, i.e., a particular set of game symbols, the odds of occurrence of that result, and hence the payout which can be assigned to that result, can be readily set. Since these selections are contained in a replaceable EPROM, the make-up of the game can be easily changed to provide greater or lesser odds (and hence greater or lesser sized payouts), and more frequent or less frequent payouts. Furthermore, by increasing the size of subsets for game results which provide symbol combinations which constitute "near wins", i.e., one symbol of the game result just one display position away from providing a winning game result, the designer can make the game more exciting to the player.

In effect, in the illustrated embodiment the game result is selected by sequentially opening windows of time for each game result where the total time duration for each event is proportional to the desired probability. An external happening, such as the actuating of a start switch by a player, will result in the selection of the event whose time window is open at that particular moment.

Figure 12:
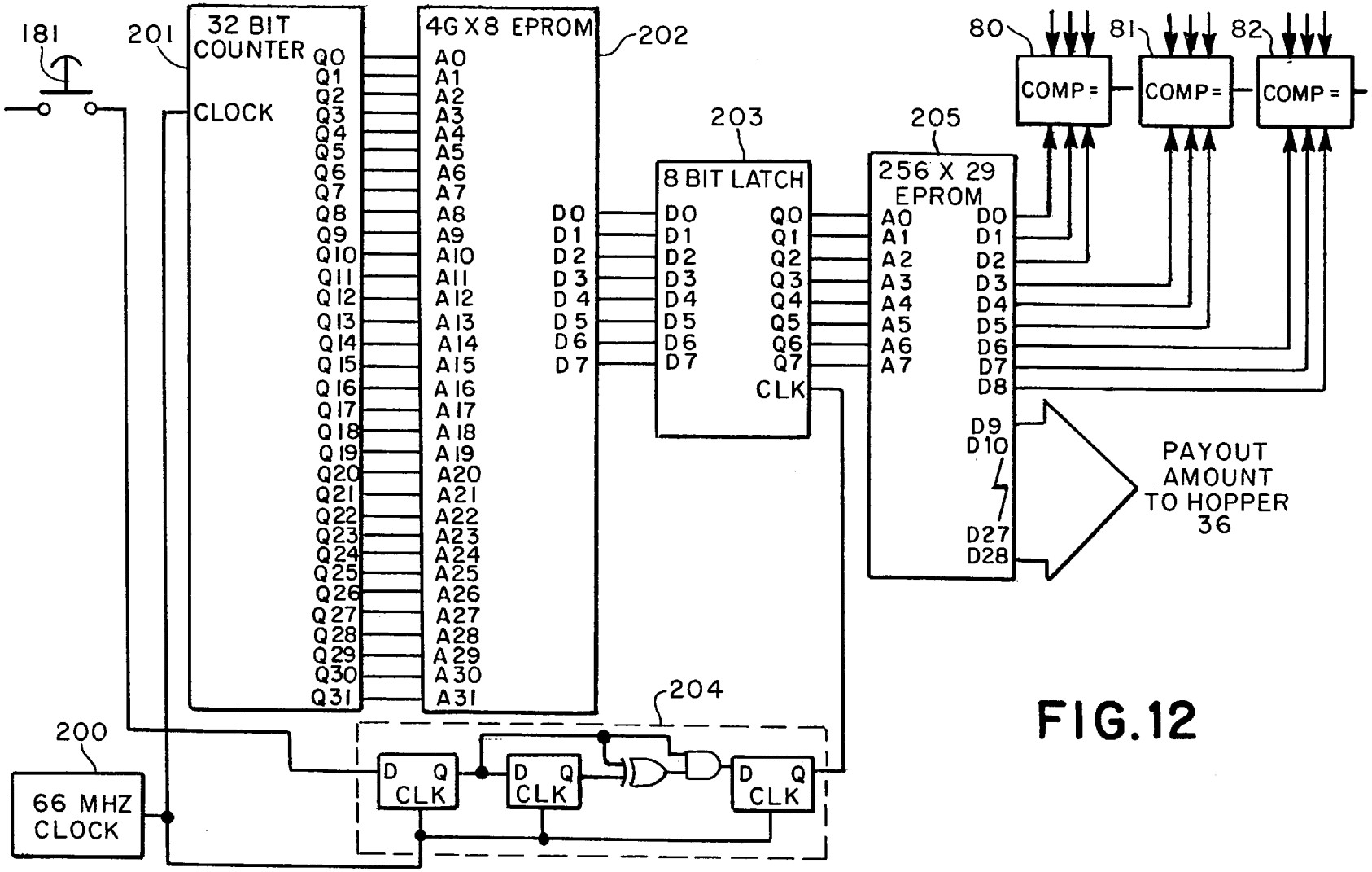
FIG. 12 is a simplified schematic diagram partially in functional block form illustrating the method of randomly selecting a game result.
Figure 13:
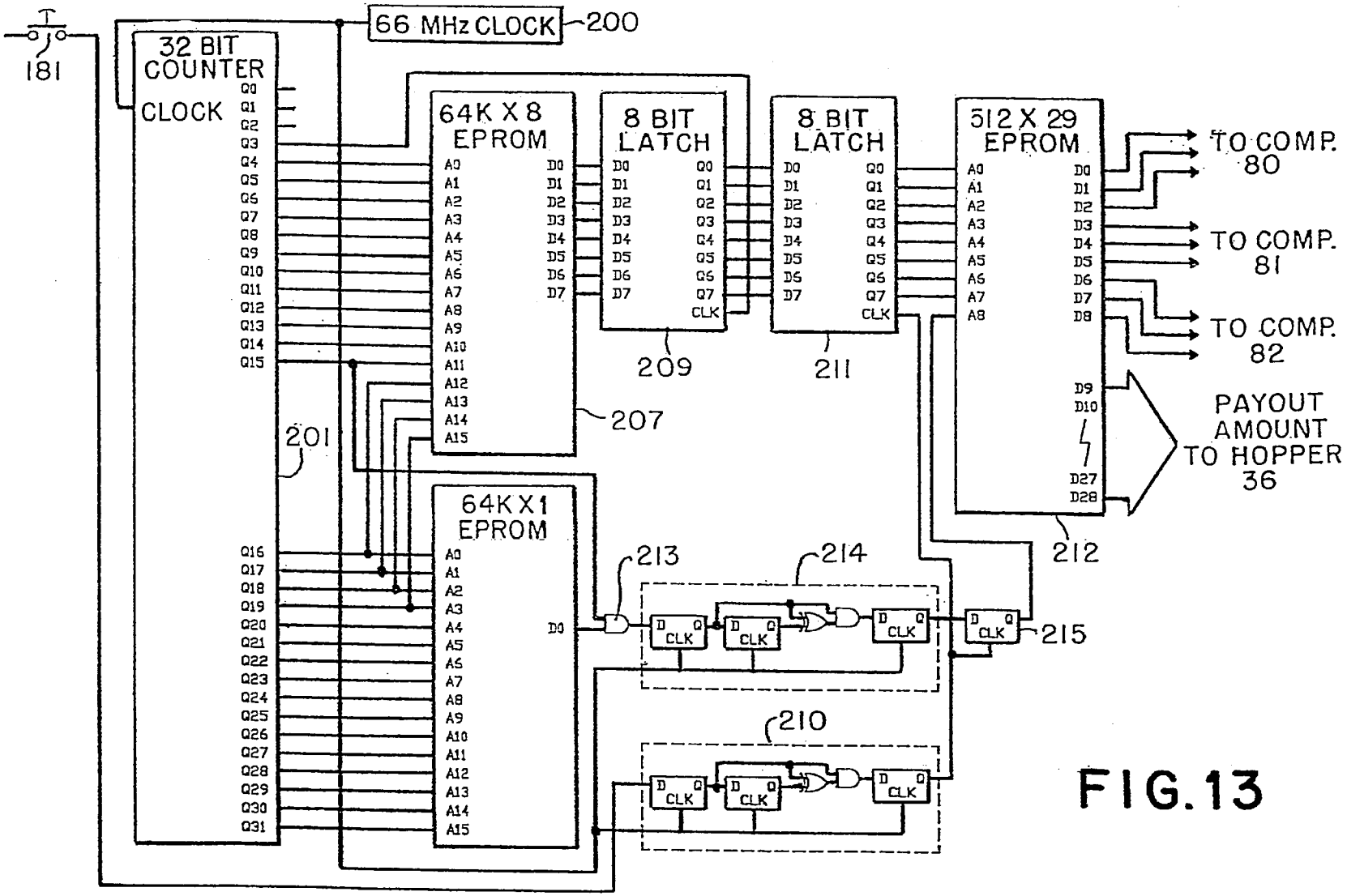
FIG. 13 is a simplified schematic diagram partially in functional block form illustrating an alternate construction for accomplishing the game selection method of FIG. 12.
Figure 14:
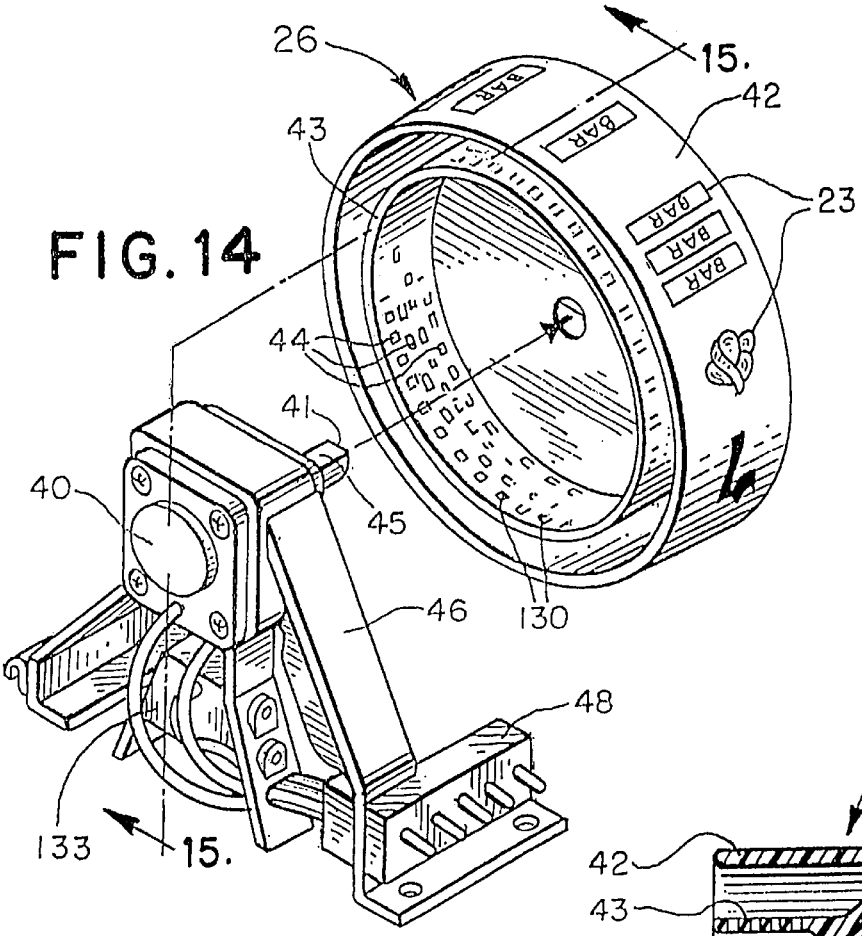
FIG. 14 is an enlarged exploded view of an alternate form of the reel assembly of FIG. 3.
Figure 15:
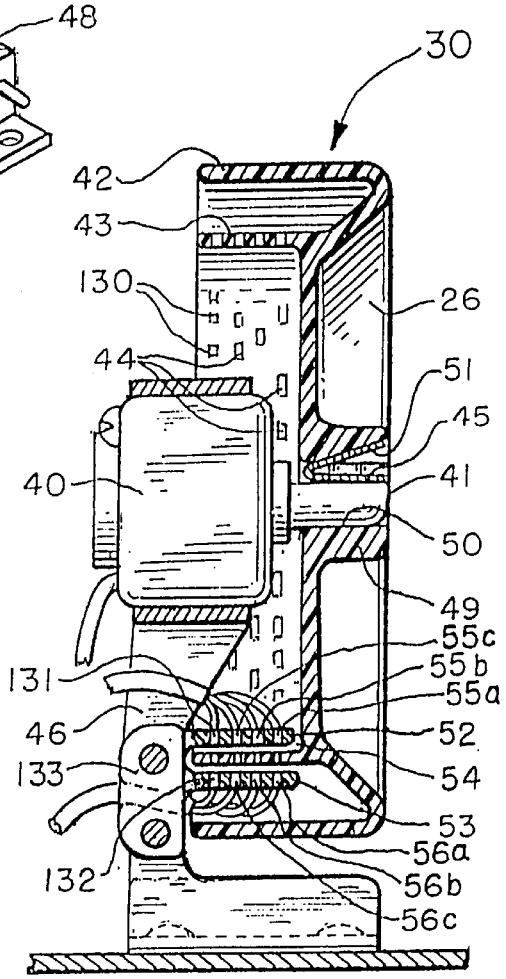
FIG. 15 is a cross-sectional view of the reel assembly of FIG. 14 taken along line 15—15 of FIG. 14.

Referring to FIGS. 12–13, this method may be implemented by utilizing a high frequency clock circuit 200 to apply clock pulses to a 32 bit counter 201. As the counter counts a 32 bit number is outputted indicating the cumulative count in the counter up to 4,294,967,295, after which the counter returns to zero and begins a new count.

The output of counter 201 is applied to an EPROM 202, which provides an 8 bit output indicative of one of the 216 previously described possible game results for each of the 4,294,967,295 counting states of counter 201. This 8 bit output is applied to a latch circuit 203, pending application of the next count from counter 201.

Upon actuation of a spin switch 181, a control pulse is applied through a conditioning circuit 204 to latch circuit 203 which causes the latch to output its contents to an EPROM 205. This device associates the eight hit game result with specific symbols to be displayed by the reels, and outputs an appropriate symbol command signal for application to the comparators 80–82 associated with reels 30–32, respectively, causing the reels to display the symbols.

Since counter 201 runs continuously, the potential game results outputted by EPROM 202 are changing continuously, the duration of any one game result depending on the size of the range of counting states assigned to that potential game result. It is not until spin switch 181 is actuated that a game result is selected for display, a truly random selection having a likelihood of occurrence depending only on the number of counting states assigned to the game result in EPROM 202.

In practice, implementation of the system of FIG. 12 would require that EPROM 202 be extraordinarily large in size and capable of very high speed performance. An implementation utilizing a pair of smaller EPROMs operating at a lower access speed is shown in FIG. 13.

Referring to FIG. 13, the high-speed clock 200 drives the 32-bit synchronous counter 201. Bits Q4 through Q19 of the counter are used to sequentially address a 64K×8 EPROM 207. The 65,536 possible EPROM addresses are divided amongst the 215 possible reel combinations (excluding the lowest probability game result, which is discussed later) in proportion to the desired probability previously tabulated in FIGS. 10A–10E.

The output data (D0–D7) of EPROM 207 is a binary encoding of the 215 line items (8 bits). For example, for line item 2 of FIG. 10A, 590 different addresses (0.009003364× 65,536) applied to EPROM 207 will result in a binary output of 00000010 (decimal 2). It is not necessary that these 590 addresses be contiguous.

In one complete cycle through the 65,536 possible addresses, which occurs every 16 milliseconds, the total time duration that each result appears at the output is proportional to the desired probability. The counter is run continuously. The data for each new address is stored in latch 209. When a positive-going transition from SPIN switch 181 occurs, the data currently stored in latch 209 is transferred to, and retained in, a latch 211 as the game result to be displayed.

At the same time as this process is occurring, additional circuitry is determining if the lowest probability combination (in this case, Item 195 of FIG. 10E, the 7-7-7 combination) should override the result obtained above. Bits Q16 through Q31 of the 32-bit counter are used as addresses for a second 64K×1 EPROM 208.

The counter 201 has a range of $2^{32}$ and, at a clock frequency of 66 megahertz, the counter will roll over every 65.075 seconds. Each address in EPROM 208 that generates a true output will in turn result in a 15.1515 nanosecond pulse (the clock period). FIG. 10E indicates the 7-7-7 combination has a target probability of 0.000000071. Therefore, the number of addresses in EPROM 208 that must generate a true output is $(65.075\times0.000000071)/(15.1515\times10^{9})=305$ addresses out of 65,536. Again, these addresses need not be contiguous.

Flip-flop 215 stores this result in response to the SPIN switch signal and, if true, it is given priority over the earlier result determined from EPROM 207. The reels are driven to the 7-7-7 combination and the jackpot payout is made.

Otherwise, after the game result is established, an EPROM 212 (with only nine address lines, A0–A8, to cover the 215 possibilities) can provide the specific symbols to be displayed by the three reels and the required payout, if any.

Circuits 210 and 214 may be identical. Their purpose is to synchronize events to the clock and overcome any switching transients and delays. They provide an output pulse in response to a positive-going transition of the signal applied to the D-input of the first flip-flop. The output pulse will start with the third clock pulse following the input signal and will have a duration precisely equal to the period of the clock.

If additional ultra-low-probability events are required, EPROM 208 could be expanded to include additional output pins which, together with circuitry identical to gate 213, circuit 214 and flip-flop 215, could provide other prioritized payouts.

Due to the high speed and highly synchronous nature of the circuitry, it could also be easily and effectively implemented in a programmable array logic device (PAL), or other similar device.

Further flexibility is provided to the designer by the construction of the reel assemblies. In particular, since display reels 26–28 can be readily removed from their associated motor shafts 41 without disturbing the sensor assemblies 47, an operator can change reel makeup at the same time he changes EPROM 79, allowing for a completely different game to be installed.

As previously mentioned, where a smaller stepper motor is utilized which provides a larger number of steps per revolution, 200 or 400 stops for example, it may be preferable to incorporate ramp-up and ramp-down routines in the starting and stopping of the display reels to prevent the stepper motors from slipping, i.e., failing to step in response to a stepper pulse. With such routines, lower rate stepping pulses are applied to the stepper motor drive circuits 91–93 for a ramp-up period following a spin command (as when spin button 181 is actuated) and for a ramp-down period following a stop command (as when a comparator generates a stop signal).

Referring to FIGS. 14–17, an advantageous construction for obtaining a stop initiating command is to provide an additional set of binary coded indicia 130 (FIG. 16) angularly displaced from the symbol-indicating stop indicia associated with the displayed game symbol. This additional stop initiating indicia, which preferably utilizes the same 3 bit binary coding as the stop command indicia, is differentiated from the stop indicia by the presence of a fourth bit, contained in a fourth column D in FIG. 16. The fourth bit may be represented by an aperture which is shorter than the apertures representing the other three bits so as to act as a strobe bit for greater precision in detecting the passage of the symbol code. An additional LED light source 131 and associated photosensor 132 are provided in a sensor assembly 133 (FIG. 15) mounted on the reel assembly frame to detect the additional bit.

Figure 16:
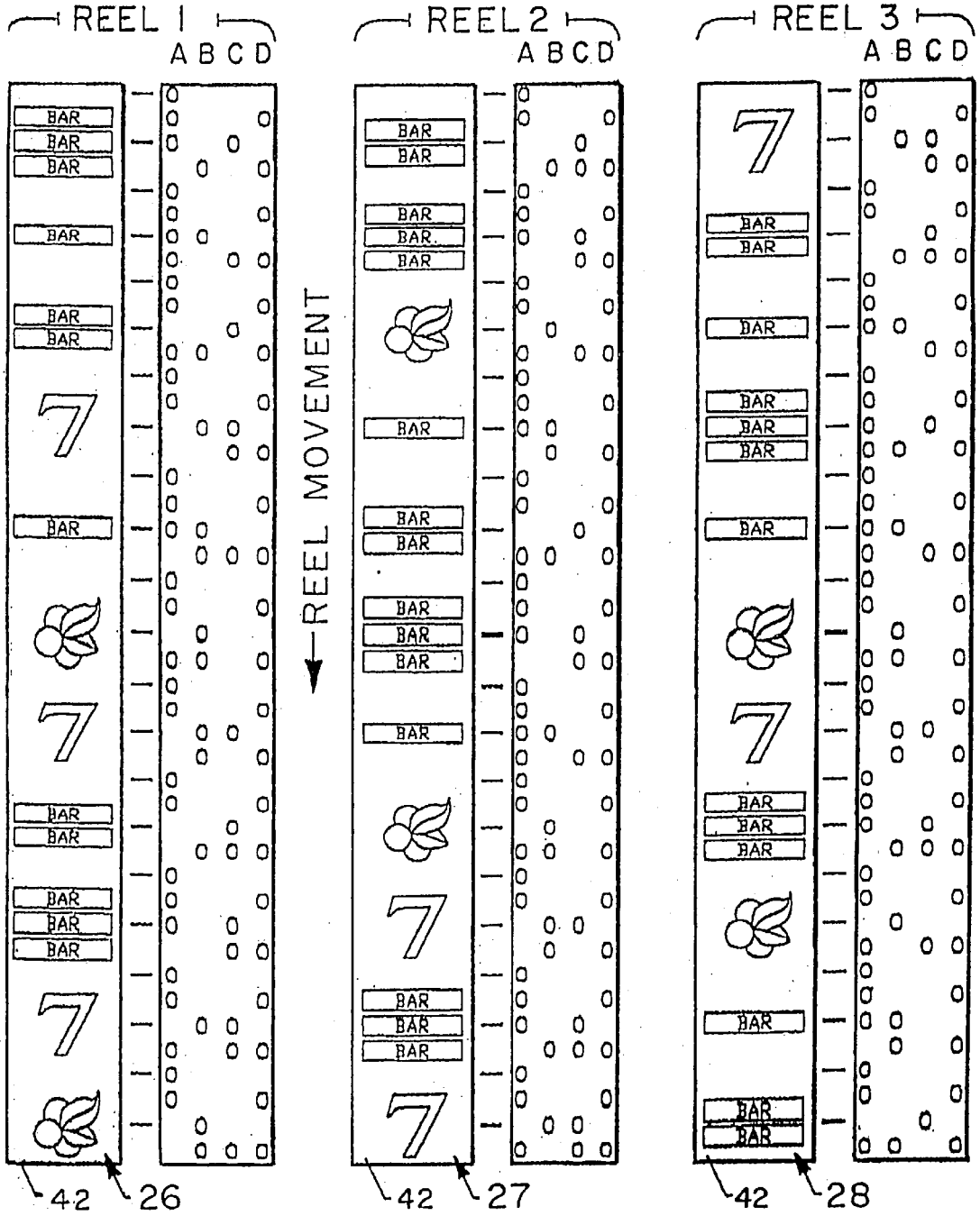
FIG. 16 is an illustration of a representative arrangement of game symbols and game symbol-indicating indicia on the alternate form of reel assembly of FIGS. 14 and 15.

As shown for the three display reels 26–28 in FIG. 16, the stop initiating indicia are spaced ahead of the stop-indicating indicia by an angular displacement sufficient to allow the display reel to be ramped down to a slow stopping speed prior to the reel reaching the stop position. When the reel reaches the stop position, as signaled by the stop-indicating indicia, the application of the slow stepping pulses is interrupted and the reel abruptly stops.

In practice, for a 200 step motor operating at 2 revolutions per second, 45 stepping pulses may be utilized in slowing the motor to a desirably slow stopping speed. This results in the stop-initiating indicia being located approximately two and one-half symbol display positions ahead of the stop-indicating indicia, as shown in FIG. 18.

Figure 17:
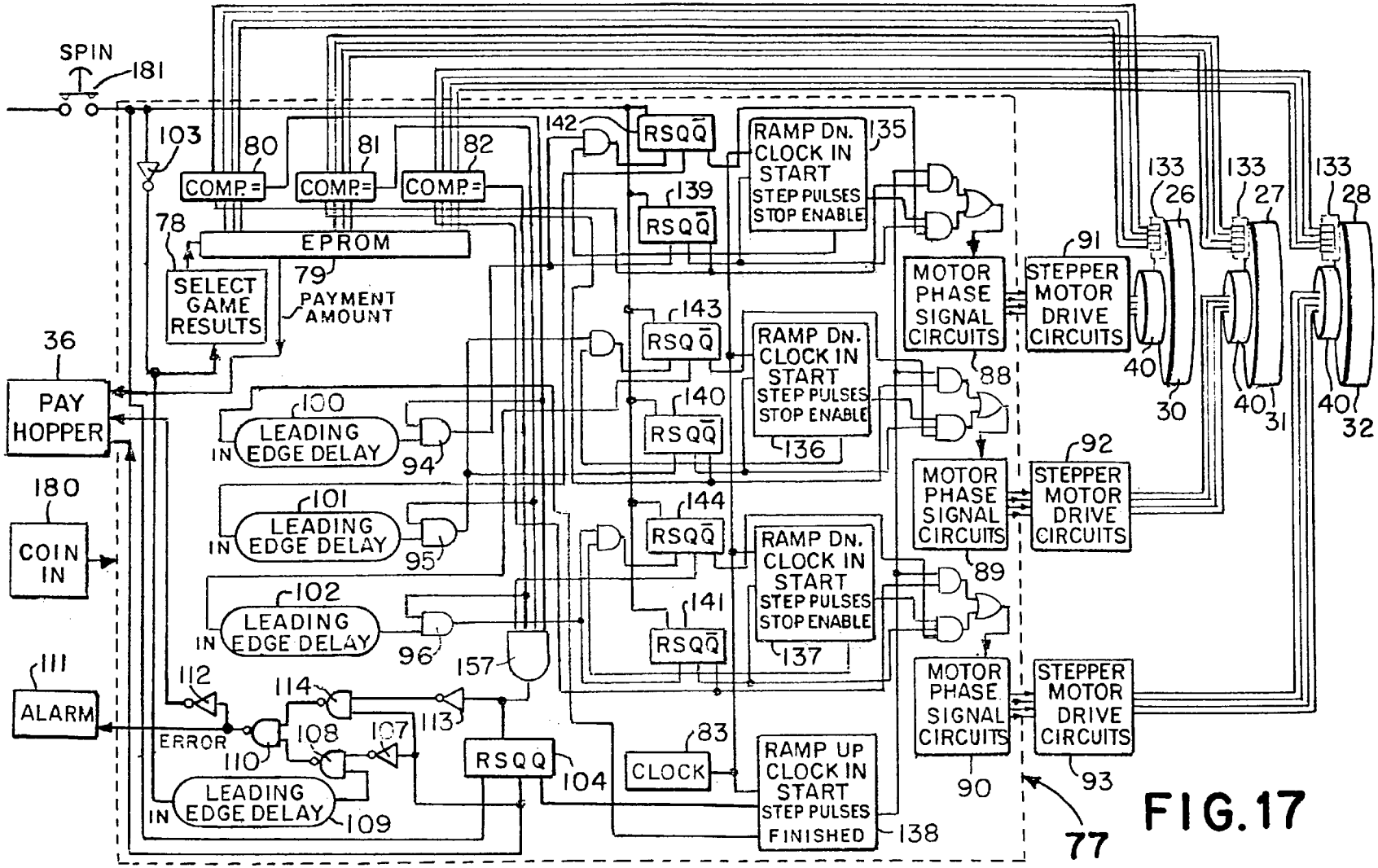
FIG. 17 is a simplified schematic partially in functional block form illustrating the operation of a slot machine utilizing the alternate reel assembly of FIGS. 14–16.
Figure 18:
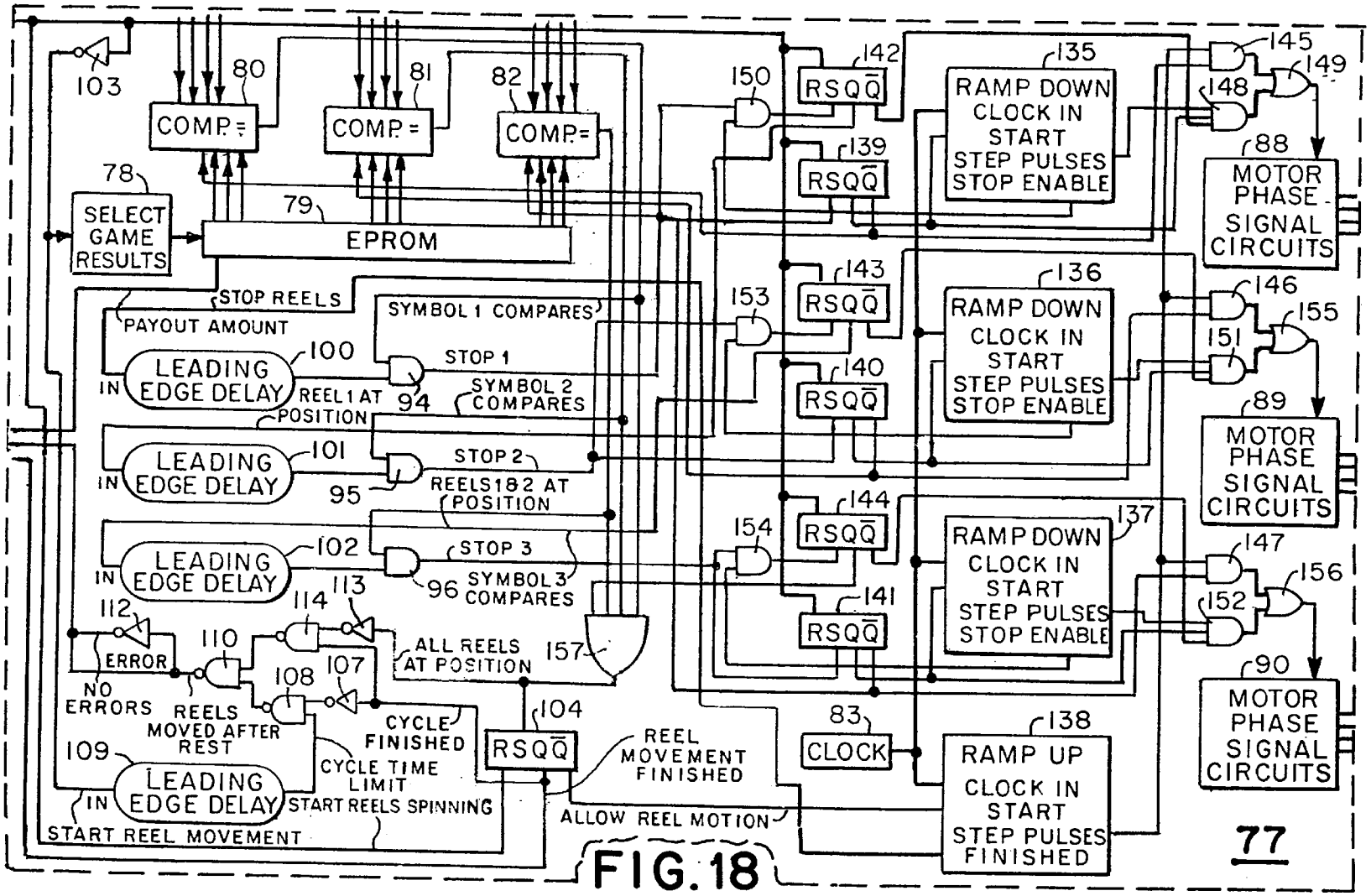
FIG. 18 is a simplified schematic diagram of a portion of the functional block diagram of FIG. 17.

Referring to FIGS. 17 and 18, three ramp-down circuits 135–137 provide decreasing rate stepping pulses to stepper motor drive circuits 91–93 during the stopping routine, and a single ramp-up circuit 138 provides increasing rate stepper pulses during the starting routine. The operation of the rampdown circuits is controlled by three RS flip-flops 139–141, which initiate the ramp-down routine, and three RS flip-flops 142–144, which stop the reels. The operation of ramp-up circuit 138 is controlled by spin switch 181.

Upon actuation of spin switch 181, all six RS flip-flops 139–144 are reset. The $\overline{Q}$ outputs of flip-flops 139–141 enable three AND gates 145–147, which allow stepper pulses developed by ramp-up circuit 138 to be applied to the three stepper motor phase signal circuits 88–90. At the same time, the $\overline{Q}$ output of RS flip-flop 104, which is reset by spin switch 181, causes ramp-up circuit 138 to initiate the ramp-up routine.

When the ramp-up routine is complete, circuit 138 provides an output to delay circuit 100, which times the free-spin period of reel 26 as previously described. After this free-spin period, AND gate 94 is enabled to allow the output of comparator 80 to initiate a stop routine. As before, comparator 80 is looking for a match with the symbol indicia provided by EPROM 79. However, the $\overline{Q}$ output of RS flip-flop 139, in its reset state, requires that the fourth bit associated with stop-initiating indicia also be present for a match. This prevents the comparator from responding to stop-indicating symbol indicia passing detector 133, and allows the comparator to respond to stop-initiating indicia on reel 26.

When a match is recognized by comparator 80, RS flip-flop 139 is set, and AND gate 145 is inhibited to prevent stepper pulses from the ramp-up circuit 138 from being applied to motor phase signal circuits 88. At the same time, the Q output of RS flip-flop 139 enables an AND gate 148, allowing pulses from ramp-down circuit 135 to be applied to stepper motor drive circuits 91 through an OR gate 149. Since the $\overline{Q}$ output of flip-flop 139 no longer requires comparator 80 to sense the fourth bit, the comparator responds to the next-occurring stop-indicating symbol indicia to provide a signal which is applied through an AND gate 150, upon receipt of a stop enabling signal from ramp-down circuit 135, to set RS flip-flop 142, which inhibits AND gate 148 to prevent further application of pulses to stepper motor drive circuits 91. Lack of the stop enabling signal from ramp-down circuit 135 prevents RS flip-flop 142 from being set by the comparison output which occurs with passage of the stop-initiating symbol indicia or with passage of any stop-indicating symbol indicia prior to the completion of a substantial portion of the ramp-down. Delay circuit 101 is actuated when RS flip-flop 142 is set to initiate the free spin period for display reel 27.

Figure 20:
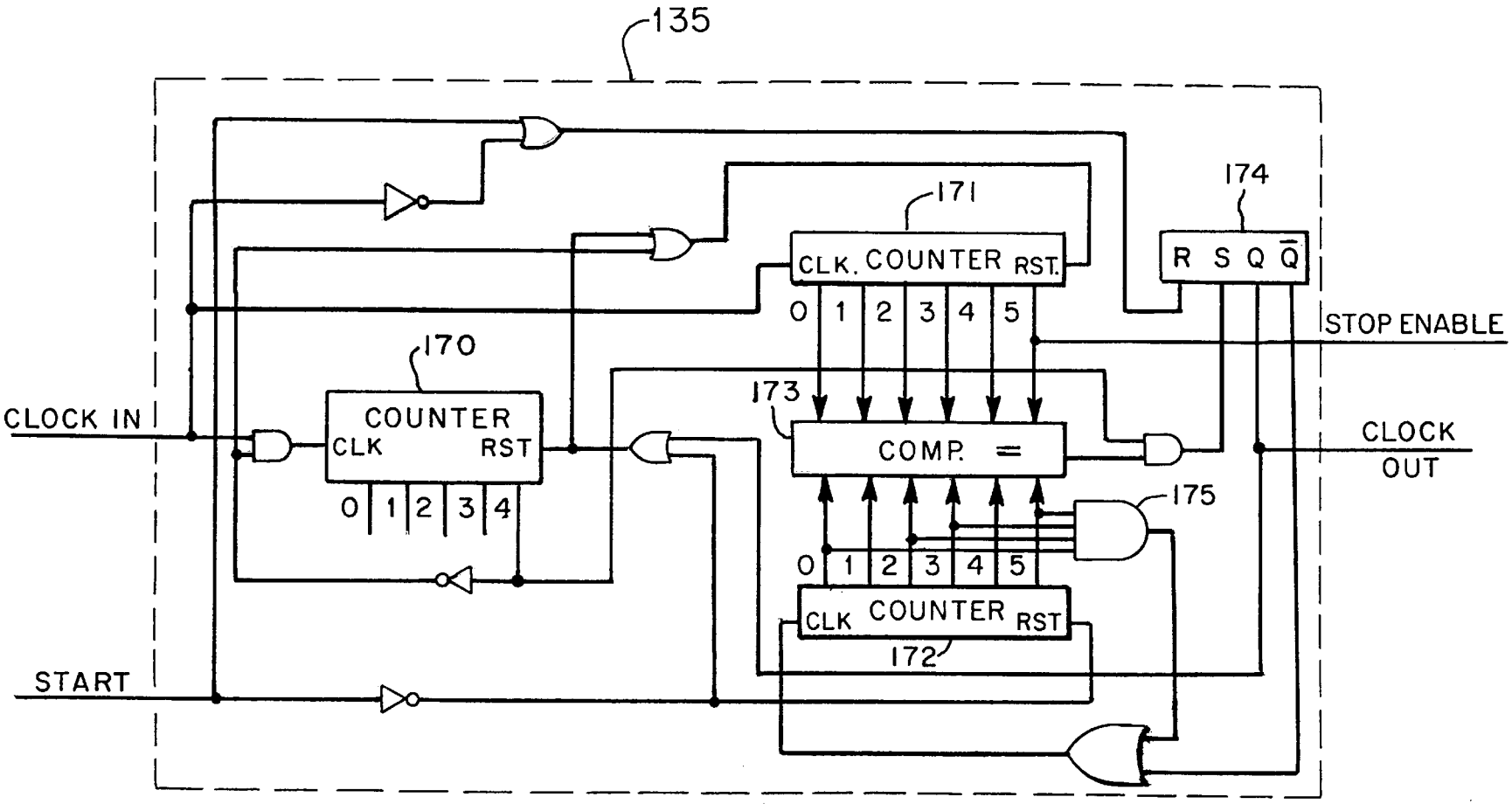
FIG. 20 is a simplified schematic diagram of the ramp down-circuit utilized in the slot machine of FIG. 17.

Display reels 27 and 28 are controlled in a similar manner by RS flip-flops 140 and 141, which initiate the ramp-down routine, and RS flip-flops 143 and 144, which stop the reels in conjunction with AND gates 151–154 and OR gates 155 and 156 (FIG. 20).

The function of RS flip-flop 104 is as previously described, except that the device is set by the output of an AND gate 157, which provides a set signal when all three comparators 80–82 indicate a match (i.e., when all three display reels are displaying the game result symbols called for by EPROM 79) and RS flip-flop 144 is set, indicating that the third reel has stopped. When these conditions are fulfilled, RS flip-flop 104 is set and NAND gate 114 is enabled, so that any subsequent change in state of AND gate 157, as by movement of a reel, causes activation of alarm 111.

Figure 19:
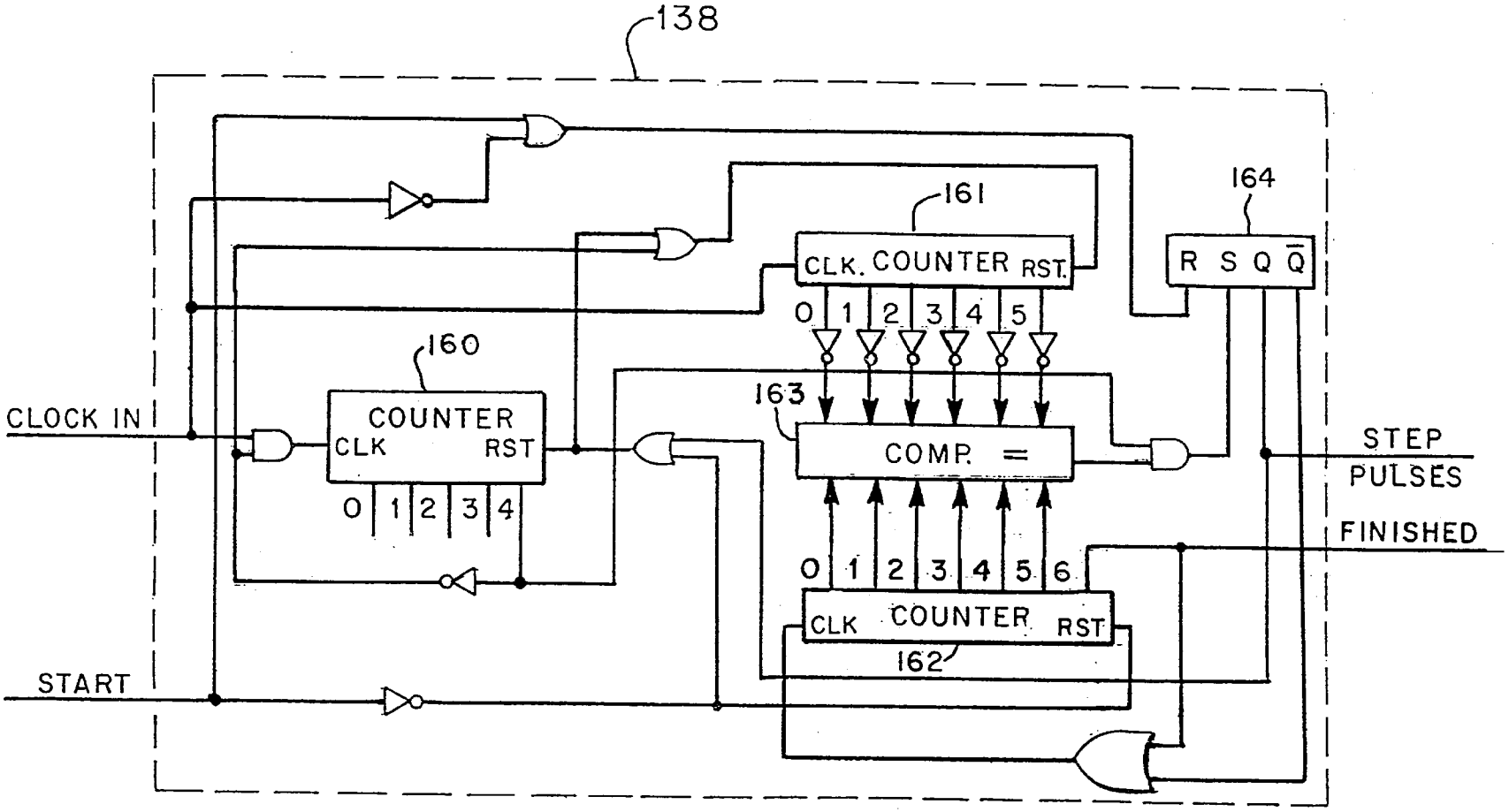
FIG. 19 is a simplified schematic diagram of the ramp-up circuit utilized in the slot machine of FIG. 17.

Referring to FIG. 19, one form of ramp-up circuit 138 suitable for use in slot machine 20 is seen to include three counters 160–162, a comparator 163, and an RS flip-flop 164. While the start signal is false, all three counters are held in reset and RS flip-flop 164 is reset. Upon actuation of spin switch 181, the start signal is true and counter 160 counts applied clock pulses until a count of 16 is reached, at which time the counter produces an output which inhibits further counting by the counter and enables counter 161 to count clock pulses. Counter 161 continues to count from zero until its output, applied inverted to comparator 163, compares to the initial zero count in counter 162. Initially, this does not occur until counter 161 has counted to its capacity count of 63, producing all logic 1's which when inverted match the all logic 0's of counter 162.

When a match is recognized by comparator 163, an output of the comparator sets RS flip-flop 164, producing at the Q output of that device a stepping pulse for application to the stepper motor phase circuits, and at the $\overline{Q}$ output a signal which increments counter 162 one count.

The Q output of RS flip-flop 164 also resets counters 160 and 161, allowing counter 160 to again count clock pulses. With the next negative transition of the clock pulse, RS flip-flop 164 is reset and counter 162 is advanced one count. When counter 160 again reaches its maximum count of 16, counter 161 is again enabled and begins counting clock pulses. Since there is now a one count in counter 162, counter 161 needs only to count to 62 before its inverted output compares with the non-inverted output of counter 162 and comparator 163 produces an output which resets RS flip-flop 164. As before, this produces a stepping pulse for application to the stepper motor phase circuits, an increment of one count in counter 162, and a reset of counters 160 and 161.

In this manner, stepping pulses are produced with linearly increasing frequency as counter 161 counts to progressively lower counting states to match the progressively increasing counting state of counter 162. In practice, the ramp-up circuit may initially produce stepping pulses at 160 hertz, ramping-up in 64 linear steps to a pulse rate of 800 hertz, which it continues to produce until a subsequent start signal is received. With a nominal clock frequency of 12.8 KHz, this results in a ramp-up speed starting at 0.4 RPS and increasing to 2.0 RPS.

The functioning of ramp-down circuit 135 is similar to ramp-up circuit 138 except that the outputs of counter 161 are applied to comparator 163 non-inverted.

Referring to FIG. 20, one form of ramp-down circuit 135 suited for use in slot machine 20 is seen to include three counters 170–172, a comparator 173 and an RS flip-flop 174. While the start signal is false, all three counters are held in reset and RS flip-flop 174 is reset. Upon actuation of spin switch 181, the start signal is true and counter 170 counts applied clock pulses until a count of 16 is reached, at which time the counter produces an output which inhibits further counting by the counter and enables counter 171 to count clock pulses. Counter 161 continues to count from zero until its output, applied to comparator 173, compares to the initial zero count in counter 172. Initially, this occurs immediately, causing the comparator to produce an output which sets RS flip-flop 174, producing at the Q output of that device a stepping pulse for application to the stepper motor phase circuits, and at the $\overline{Q}$ output a signal which increments counter 172 one count.

The Q output of RS flip-flop 174 also resets counters 170 and 171, allowing counter 170 to again count clock pulses. With the next negative transition of the clock pulse, RS flip-flop 174 is reset and counter 172 is advanced one count. When counter 170 again reaches its maximum count of 16, counter 171 is again enabled and begins counting clock pulses. Since there is now a one count in counter 172, counter 171 needs to count to 1 before its output compares with the output of counter 172 and comparator 173 produces an output which resets RS flip-flop 164. As before, this produces a stepping pulse for application to the motor phase circuits, an increment of one count in counter 172, and a reset of counters 170 and 171. This cycle continues until counter 172 reaches its maximum counting state of 43, as determined by an AND gate 175, at which time counter 172 is no longer incremented and RS flip-flop 174 is regularly toggled at a fixed slow rate as counter 171 repeatedly counts to 63.

In this manner, stepping pulses are produced with linearly decreasing frequency as counter 171 is required to count to progressively higher counting states to match the progressively increasing counting state of counter 172. In practice, the ramp-down circuit may initially produce stepping pulses at 800 hertz, and ramp-down in 45 linear steps to a pulse rate of 210 hertz, at which rate it continues to produce pulses until a stop signal is received. With a nominal clock frequency of 12.8 KHz, this results in a ramp-down speed starting at 2 RPS and ending at 0.4 RPS.

While the ramp-up and ramp-down functions have been illustrated using discrete logic components, it will be appreciated that all of the same functions and results can be advantageously performed by a conventional microprocessor using well known conventional programming techniques.

A slot machine has been shown and described wherein a game result is randomly selected from a series of potential game results, game symbols are identified for display by each reel, and the reels are spun and stopped by symbol detecting sensors to display the game result. By changing an EPROM, the probability of a particular game result occurring can be quickly and easily changed by a technician.

While particular embodiments of the invention have been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

We claim:

1. A reel-type slot machine comprising:

a user-actuated spin switch for providing a play command;

at least one display reel having a plurality of different game symbols thereon, said display reel being rotatably mounted to selectively display one of said game symbols;

reel drive means responsive to said play command for rotatably driving said display reel;

selection means responsive to said play command for randomly selecting one game result from a predetermined set of potential game results, said game result having an associated predetermined game symbol for display by said display reel, said selection means providing a display control signal indicative of said predetermined display symbol; and display control means responsive to said display control signal for causing said reel drive means to position said reel to display said predetermined game symbol, wherein at least one undesirable game result is eliminated from said predetermined set of potential game results by having each of the undesirable game result's probability set to zero.

2. A reel-type slot machine as defined in claim 1 wherein said display reel contains at least two of each of said different game symbols.

3. A reel-type slot machine as defined in claim 1 wherein said display reel includes indicia fixedly positioned thereon for identifying each of said game symbols thereon, and said display control means is responsive to said display control signal and to said indicia.

4. A reel-type slot machine as defined in claim 3 further including indicia detection means fixedly positioned relative to said display reel for detecting the passage of each of said game symbols as said display reel rotates, said display control means being responsive to said indicia detection means for causing said reel drive means to position said display reel to display said associated game symbol.

5. A reel-type slot machine as defined in claims 3 or 4 wherein said display reel has at least five different symbols and said indicia comprises at least three binary digits.

6. A reel-type slot machine as defined in claim 1 wherein said reel drive means comprise a stepper motor.

7. A reel-type slot machine as defined in claim 6 wherein said reel drive means is responsive to applied stepping pulses, and said display control means interrupt said stepping pulses to stop said display reel.

8. A slot machine as defined in claim 1 wherein said selection means comprise means for generating a time sequential series of signals each representing a potential game result from said predetermined set of potential game results, said entire set of potential game results being repetitively generated;

a selector circuit responsive to said play command for selecting one of said sequential series of signals; and a memory device containing a look-up table for providing said associated predetermined game symbol in accordance with the game result corresponding to said selected game signal.

9. A slot machine as defined in claim 8 wherein said memory device comprises an electronically programmable read only memory (EPROM).

10. A reel type slot machine as defined in claim 8 wherein at least one of said different potential game results appears multiple times within said predetermined set of potential game results, the number of said appearances determining the probability of said game result being selected in response to said play command.

11. A reel type slot machine as defined in claim 8 wherein said machine has multiple display reels each having a plurality of different game symbols thereon, said memory device provides respective predetermined game symbols for display by each of said display reels, and said display control means cause said display reels to display respective ones of said predetermined game symbols.

12. A reel type slot machine as defined in claim 1 wherein one of said potential game results in said set is undesired, and said predetermined set of same results excludes said undesired game result.

13. A reel-type slot machine comprising:

a user actuated spin switch for providing a play command;

at least one display reel having a plurality of different game symbols thereon, said display reel being rotatably mounted to selectively display one of said game symbols, and including indicia fixedly positioned thereon indicative of each game symbol thereon;

reel drive means responsive to said spin command for rotatably driving said display reel;

selection means responsive to said play command for randomly selecting one game result from a predetermined set of potential game results, said game result having an associated predetermined game symbol for display by said display reel, said selection means providing a display control signal indicative of said predetermined game symbol;

indicia detection means fixedly positioned relative to said display reel for providing a tracking signal indicating the passage of each of said game symbols thereon as said display reel rotates; and display control means responsive to said display control signal and to said tracking signal for causing said reel drive means to position said reel to display said associated game symbol, wherein at least one undesirable game result is eliminated from said predetermined set of potential game results by having a probability of the at least one undesirable game result set to zero.

14. A reel-type slot machine as defined in claim 13 wherein said display reel contains at least two of each of said different game symbols.

15. A reel-type slot machine as defined in claim 13 wherein said display reel has at least five different symbols and said indicia comprises at least three binary digits.

16. A slot machine as defined in claim 13 wherein said selection means comprise means for generating a time sequential series of signals each representing a potential game result from said predetermined set of potential game results, said entire set of potential game results being repeatedly generated;

a selector circuit responsive to said play command for selecting one of said sequential series of signals; and a memory device containing a look-up table for providing said associated predetermined game symbol in accordance with the game result corresponding to said selected game signal.

17. A slot machine as defined in claim 16 wherein said memory device comprises an electronically programmable read only memory (EPROM).

18. A reel type slot machine as defined in claim 16 wherein at least one of said different potential game results appears multiple times within said predetermined set of potential game results, the number of said appearances determining the probability of respective ones of said game results being selected in response to said play command.

19. A reel type slot machine as defined in claim 16 wherein said slot machine has multiple display reels each having a plurality of different game symbols thereon, said memory device provides predetermined game symbols for display respectively by each of said display reels, and said display control means cause said reel drive means to position each of said display reels to display its respective predetermined game symbol.

20. A reel type slot machine as defined in claim 16 wherein one of said potential game results in said set is undesired, and said time sequential series of signals excludes a signal corresponding to said undesired game result.

21. A reel-type slot machine comprising:

a user actuated spin switch for providing a play command;

at least one display reel having a plurality of different game symbols thereon, said display reel being rotatably mounted to selectively display one of said game symbols;

reel drive means responsive to said play command for rotatably driving said display reel;

means for generating a time sequential series of signals each representing a potential game result from a predetermined set of potential game results each having at least one associated predetermined game symbol for display, said entire set of potential game results being repetitively generated;

a selector circuit responsive to said play command for selecting one of said sequential series of signals;

a memory device containing a look-up table for providing predetermined a game symbol associated with said selected game result; and display control means for causing said reel drive means to position said display reel to display said predetermined game symbol, wherein at least one undesirable game result is eliminated from said predetermined set of potential game results by having a probability of the at least one undesirable game result set to zero.

22. A slot machine as defined in claim 21 wherein said memory device comprises an electronically programmable read only memory (EPROM).

23. A reel type slot machine as defined in claim 21 wherein at least one of said different potential game results appears multiple times within said predetermined set of potential game results, the number of said appearances determining the probability of said game result being selected in response to said play command.

24. A reel type slot machine as defined in claim 21 wherein said machine has multiple display reels each having a plurality of different game symbols thereon, said memory device provides predetermined game symbols for display respectively by each of said display reels, and said display control means cause said display reels to display respective ones of said predetermined game symbols.

25. A reel-type slot machine as defined in claim 21 wherein said display reel contains at least two of each of said plurality of different game symbols.

26. A reel-type slot machine as defined in claim 21 wherein said display reel includes indicia fixedly positioned on said reel for identifying each of said game symbols thereon, and said display control means is responsive to said display control signal and said indicia.

27. A reel-type slot machine comprising:

a user actuated spin switch for providing a play command;

at least one display reel having a plurality of different game symbols thereon, said display reel being rotatably mounted to selectively display one of said game symbols, and including indicia fixedly positioned thereon position-indicative of said game symbols thereon;

reel drive means responsive to said play command for rotatably driving said display reel;

means for generating a time sequential series of signals each representing a potential game result from said predetermined set of potential game results, said series being repetitively generated;

a selector circuit responsive to said play command for selecting one of said sequential series of signals;

a memory device containing a look-up table for providing a predetermine game symbol associated with the game result corresponding to said selected signal, and for further providing a display control signal indicative of said predetermined game signal;

indicia detection means fixedly positioned relative to said display reel for providing a tracking signal indicating the passage of each of said game symbols thereon with rotation of the reel; and display control means responsive to said display control signal and said tracking signal for causing said reel drive means to position said display reel to display said predetermined game symbol, including at least one undesirable game result in said predetermined set of game results, and wherein said series of signals excludes a signal corresponding to said undesirable game result by having a probability for the at least one undesirable game result set to zero.

28. A reel-type slot machine as defined in claim 27 wherein said display reel contains at least two of each of said different game symbols.

29. A reel-type slot machine as defined in claim 27 wherein said display reel has at least five different symbols and said indicia comprises at least three binary digits.

30. A reel-type slot machine as defined in claim 27 wherein said reel drive means comprise a stepper motor.

31. A reel-type slot machine as defined in claim 30 wherein said reel drive means is responsive to applied stepping pulses, and said display control means interrupt said stepper pulses to position said display reel.

32. A slot machine as defined in claim 27 wherein said memory device comprises an electronically programmable read only memory (EPROM).

33. A reel type slot machine as defined in claim 27 wherein at least one of said different potential game results appears multiple times within said predetermined set of potential game results, the number of said appearances determining the probability of said game result being selected in response to said play command.

34. A reel type slot machine as defined in claim 27 wherein said machine has multiple display reels each having a plurality of different game symbols thereon, said memory device provides predetermined game symbols for display respectively by each of said display reels, and said display control means cause said display reels to display respective ones of said predetermined game symbols.

35. A reel-type slot machine comprising:

a user actuated spin switch for providing a spin command;

a plurality of display reels each having a plurality of different game symbols thereon, said display reels each being rotatably mounted to selectively display one of said game symbols;

a plurality of reel drive means each responsive to said spin command for rotatably driving said display reels;

selection means responsive to said play command for randomly selecting one game result from a predetermined set of potential game results, said game result providing a plurality of associated predetermined game symbols for display by respective ones of said display reels, said selection means providing a plurality of display control signals indicative thereof; and display control means responsive to said display control signals for causing said reel drive means to position said display reels to display said predetermined game symbols associated with said selected game result, wherein at least one undesirable potential game result is eliminated from said predetermined set of potential game results by having a probability of each undesirable game result set to zero.

36. A reel-type slot machine as defined in claim 35 wherein each of said display reels contain at least two of each of said different game symbols.

37. A reel-type slot machine as defined in claim 35 wherein each of said display reels includes indicia fixedly positioned thereon for position-identifying each of said game symbols thereon, and said display control means is responsive to said indicia.

38. A reel-type slot machine as defined in claim 37 further including indicia detection means fixedly positioned relative to said display reels for detecting the passage of each of said game symbols and providing tracking signals indicative thereof as said reels rotate, said display control means being responsive to said display control signals and said tracking signals for stopping said display reels to display said predetermined game symbols.

39. A reel-type slot machine as defined in claim 37 wherein said display reel has at least five different symbols and said indicia comprises at least three binary digits.

40. A reel-type slot machine as defined in claim 35 wherein said reel drive means comprise a plurality of stepper motors respectively associated with said display reels.

41. A reel-type slot machine as defined in claim 35 wherein said reel drive means are responsive to applied stepping pulses, and said display control means interrupt said stepping pulses to stop said display reels.

42. A reel-type slot machine comprising:

a user actuated spin switch for providing a spin command;

a plurality of display reels each having a plurality of different game symbols thereon, said display reels each being rotatably mounted to selectively display one of said game symbols thereon;

a plurality of reel drive means each responsive to said spin command for rotatably driving said display reels;

means for generating a time sequential series of signals each representing a potential game result from said predetermined set of game results;

a selector circuit responsive to said play command for selecting one of said sequential series of signals;

a memory device containing a look-up table for providing predetermined game symbols for display by respective ones of said display reels in accordance with said selected game result, said memory device providing a plurality of display control signals indicative of said predetermined game signals; and display control means responsive to said display control signals for causing said reel drive means to position said reels to display said predetermined game symbols associated with said selected game result, wherein at least one undesirable potential game result is eliminated from said predetermined set of potential game results by having a probability of each undesirable game result set to zero.

43. A slot machine as defined in claim 42 wherein said memory device comprises an electronically programmable read only memory (EPROM).

44. A reel type slot machine as defined in claim 42 wherein at least one of said different potential game results appears multiple times within said predetermined set of potential game results, the number of said appearances determining the probability of said game result being selected in response to said play command.

* * * * *